US010874930B2

(12) United States Patent
Schwartz

(10) Patent No.: US 10,874,930 B2
(45) Date of Patent: Dec. 29, 2020

(54) PROTECTIVE TRACK AND FIELD BARRIER SYSTEM

(71) Applicant: UCS, INC., Lincolnton, NC (US)

(72) Inventor: Jeffrey Schwartz, Alpine, NJ (US)

(73) Assignee: UCS, INC., Lincolnton, NC (US)

( * ) Notice: Subject to any disclaimer, the term of this patent is extended or adjusted under 35 U.S.C. 154(b) by 0 days.

(21) Appl. No.: 16/119,617

(22) Filed: Aug. 31, 2018

(65) Prior Publication Data

US 2019/0070481 A1 Mar. 7, 2019

Related U.S. Application Data

(60) Provisional application No. 62/553,290, filed on Sep. 1, 2017.

(51) Int. Cl.
*A63B 67/00* (2006.01)
*A63B 71/02* (2006.01)

(52) U.S. Cl.
CPC ..... *A63B 71/022* (2013.01); *A63B 71/023* (2013.01); *A63B 2071/025* (2013.01); *A63B 2209/00* (2013.01); *A63B 2209/02* (2013.01); *A63B 2210/50* (2013.01); *A63B 2225/09* (2013.01); *A63B 2225/093* (2013.01); *A63B 2244/15* (2013.01); *A63B 2244/17* (2013.01)

(58) Field of Classification Search
CPC ..... A63B 71/022; A63B 71/023; A63B 2071/025; A63B 2209/00; A63B 2210/50; A63B 2209/02; A63B 2225/09; A63B 2225/093; A63B 2244/15; A63B 2244/17
USPC ..... 473/421, 470, 471, 422, 415; 472/92–94
See application file for complete search history.

(56) References Cited

U.S. PATENT DOCUMENTS 1,853,367 A * 4/1932 Mace ..... E04H 15/48 135/123
1,958,296 A * 5/1934 Crow ..... E04H 15/48 135/122
3,222,067 A * 12/1965 Litwhiler ..... A63B 71/022 473/421

(Continued)

FOREIGN PATENT DOCUMENTS

CN 203487814 U 3/2014

OTHER PUBLICATIONS

UCS 2015 Track and Field Catalog. UCSspirit.com. pp. 30-32 and 48-49.

(Continued)

*Primary Examiner* — Mitra Aryanpour
(74) *Attorney, Agent, or Firm* — Moore & Van Allen PLLC; W. Kevin Ransom; R. W. McCord Rayburn

(57) ABSTRACT

A protective barrier system is provided, the protective barrier system comprising: at least one support member configured for coupling to a surface; a frame comprising an upper portion and a lower portion, the upper portion being coupled to the at least one support member; a barrier material coupled to and suspended between the upper portion and the lower portion of the frame, the barrier material forming an enclosure having an interior and an exterior; and a door positioned relative to the enclosure and configured to provide access to the interior of the enclosure, wherein the barrier material is spaced from the at least one support member; and wherein the frame provides shape and structure to the barrier material.

19 Claims, 20 Drawing Sheets

(56) References Cited

U.S. PATENT DOCUMENTS 3,513,862 A * 5/1970 Pohl ..... E04H 15/644 135/117
3,797,827 A * 3/1974 Child ..... A63B 47/025 473/166
D276,466 S * 11/1984 Giovagnoli ..... 473/421
4,569,515 A * 2/1986 Gordon ..... A63B 5/11 273/401
4,748,995 A * 6/1988 Viglione ..... E04F 10/04 135/130
4,890,834 A * 1/1990 Ponza ..... A63B 47/025 473/421
5,547,186 A * 8/1996 Papp ..... A63B 47/025 473/163
5,560,385 A * 10/1996 Zheng ..... A63B 9/00 135/117
5,634,638 A * 6/1997 Havens ..... A63B 71/022 135/128
5,655,766 A * 8/1997 Klebe, Jr. ..... A63B 71/022 473/197
5,730,666 A 3/1998 Hudson
5,810,363 A * 9/1998 Saunders ..... F41J 1/00 273/400
6,240,940 B1 * 6/2001 Carter ..... E04H 15/50 135/145
6,289,910 B1 * 9/2001 Zheng ..... A63B 9/00 135/125
6,332,284 B1 * 12/2001 Tafforeau ..... G09F 15/0025 160/135
6,394,918 B1 * 5/2002 Erhard ..... A63C 19/06 472/92
6,494,224 B2 * 12/2002 Zheng ..... A63B 9/00 135/125
6,550,491 B1 * 4/2003 Bixler ..... A63B 71/022 135/121
6,729,981 B1 * 5/2004 Clifton ..... A63B 69/0002 473/421
6,939,255 B2 * 9/2005 Peterson ..... A63B 71/022 473/415
7,297,076 B2 * 11/2007 Pohrer ..... A63B 61/00 473/421
7,455,603 B2 * 11/2008 Bouffard ..... A63B 63/004 248/156
D658,779 S * 5/2012 Sovereign ..... D25/18
8,172,703 B2 * 5/2012 Lay ..... A63B 71/022 473/421
8,523,716 B2 * 9/2013 Simon ..... A63B 61/02 473/492
8,875,772 B1 * 11/2014 Dixon, Jr. ..... A63B 71/022 473/421
9,017,179 B1 * 4/2015 Moody ..... A63C 19/08 472/92
9,155,957 B1 * 10/2015 Moody ..... A63C 19/08 472/92
9,289,673 B1 * 3/2016 Allen ..... A63B 71/022 473/421
9,295,899 B1 * 3/2016 Dixon, Jr. ..... A63B 71/022 473/421
9,453,356 B2 * 9/2016 Lyndaker ..... A63B 71/0054 256/19
10,188,932 B1 * 1/2019 Fierbaugh ..... A63B 71/0616 473/421
10,226,682 B2 * 3/2019 Mulholland ..... A63B 71/022 473/421
D844,809 S * 4/2019 Ivanovich ..... D25/12
2002/0098920 A1 * 7/2002 Bruyer ..... A63B 71/022 473/421
2005/0109998 A1 * 5/2005 Sadinsky ..... E04H 4/06 256/25
2007/0023075 A1 * 2/2007 Nissenbaum ..... A63B 71/022 135/156
2016/0236063 A1 8/2016 Bowman

OTHER PUBLICATIONS

Polanik 1966-2016 Catalog. pp. 1, 9, 13-14, 19-21, 26 and 73.
Gill Athletics 2008 Track & Field Catalog. Edition 1. pp. 38-41.
Polanik 2008 Catalog. pp. 6 and 9.
UCS 1997 Track and Field Catalog. pp. 54-55.

* cited by examiner

PROTECTIVE TRACK AND FIELD BARRIER SYSTEM

CROSS-REFERENCE TO RELATED APPLICATIONS

This application is a non-provisional filing of U.S. Provisional Application No. 62/553,290 filed Sep. 1, 2017, the contents of which are hereby incorporated by reference herein.

FIELD OF THE INVENTION

The present invention relates to a protective barrier cage system for use in track and field events such as hammer and/or discus throwing.

BACKGROUND

Track and field events such as hammer throw and discus throw involve athletes rapidly gaining momentum and using it to throw weighted objects (i.e., a hammer or discus) across distances. As a high level of skill is required for precise release of the objects towards an intended target, accidental releases in unintended directions are not uncommon. As a result, protective barriers are typically employed during said events to contain misthrown objects and prevent spectator injury.

Existing protective barriers typically employ systems of large posts and fences which, while durable, tend to significantly obstruct the spectators' views of the competing athlete inside as a trade-off for providing a structure that will not easily fail. Accordingly, there exists a need for an improved protective track and field barrier system that can provide high spectator visibility of a competing athlete while maintaining structural integrity.

BRIEF SUMMARY

The following presents a simplified summary of one or more embodiments of the invention in order to provide a basic understanding of such embodiments. This summary is not an extensive overview of all contemplated embodiments, and is intended to neither identify key or critical elements of all embodiments, nor delineate the scope of any or all embodiments. Its sole purpose is to present some concepts of one or more embodiments in a simplified form as a prelude to the more detailed description that is presented later.

A protective barrier system is provided, the protective barrier system comprising: at least one support member configured for coupling to a surface; a frame comprising an upper portion and a lower portion, the upper portion being coupled to the at least one support member; a barrier material coupled to and suspended between the upper portion and the lower portion of the frame, the barrier material forming an enclosure having an interior and an exterior; and a door positioned relative to the enclosure and configured to provide access to the interior of the enclosure, wherein the barrier material is spaced from the at least one support member; and wherein the frame provides shape and structure to the barrier material.

In one embodiment, the at least one support member comprises a vertical post configured for coupling to a base and at least one curved extension extending from the vertical post.

In another embodiment, the at least one support member is positioned on an exterior side of the enclosure.

In yet another embodiment, the door comprises at least one door support member comprising a vertical post configured for coupling to a door base and at least one curved extension extending from the vertical post, wherein at least an upper portion of the frame is coupled to the at least one door support member and the barrier material is spaced from the at least one door support member of the door.

In yet another embodiment, the at least one door support member comprises a forked support member forming the door, the forked support member comprising a first curved extension and a second curved extension.

In yet another embodiment, the at least one door support member comprises: a first cable connected between the first curved extension and the door base; and a second cable connected between the second curved extension and the door base.

In yet another embodiment, the first curved extension and the second curved extension of the at least one door support frame do not extend parallel to each other.

In yet another embodiment, the protective barrier system further comprises at least first and second doors located opposite of each other, wherein each door is independently positionable between an open state and a closed state.

In yet another embodiment, the door is operatively coupled to the lower portion of the frame with a hinge, wherein the door is configured to be positioned between an open state and a closed state. In yet another embodiment, the hinge comprises a band clamp configured for adjusting a tightness of the hinge.

In yet another embodiment, the door base comprises a wheel housing comprising wheels operatively coupled to the door base forward of the barrier material on an interior side of the enclosure, the wheels being configured for traveling along the surface during a repositioning of the door. In yet another embodiment, the door base further comprises padding covering the wheel housing on the interior side of the enclosure.

In yet another embodiment, the at least one support member further comprises a vertical cable extending from the at least one curved extension to the base, wherein the vertical cable is configured to prevent the barrier material from contacting the forked support member.

In yet another embodiment, the vertical cable comprises tubing positioned along a length of the vertical cable, the tubing configured to prevent contact between the barrier material and the vertical cable.

In yet another embodiment, the frame further comprises a plurality of vertical cables extending between the upper portion and the lower portion, the plurality of vertical cables positioned adjacent the barrier material on an exterior side of the enclosure.

In yet another embodiment, each of the upper portion and the lower portion of the frame comprises a lateral support cable operatively coupled to an exterior-facing side of the upper portion and the lower portion, wherein the barrier material is operatively coupled to the frame with one or more attachment mechanisms along the lateral support cable.

In yet another embodiment, the frame has a curvilinear shape. In yet another embodiment, the frame is U-shaped.

In yet another embodiment, the barrier material is a net, fence, or mesh. In yet another embodiment, the barrier material comprises ultra-high molecular weight polyethylene.

In yet another embodiment, the base comprises a height adjustment mechanism configured for adjusting the height of the vertical post from the surface.

In yet another embodiment, the protective barrier system further comprises a foundation formed in the surface, wherein the at least one support member is operatively coupled to the foundation.

A protective barrier system is also provided, the protective barrier system comprising: at least one support member positioned on a surface; a frame comprising an upper portion and a lower portion, the upper portion being coupled to the at least one support member; a barrier material coupled to and suspended between the upper portion and the lower portion, the barrier material forming an enclosure having an interior and an exterior, wherein the barrier material is spaced from the at least one support member; and a door positioned on the enclosure and configured to provide access to the interior of the enclosure, wherein the door comprises at least one door support member comprising a vertical post configured for coupling to a door base and at least one curved extension extending from the vertical post, wherein at least the upper portion of the frame is coupled to the at least one door support member and the barrier material is spaced from the at least one door support member of the door, wherein the frame provides shape and structure to the barrier material.

A protective barrier system is also provided, the protective barrier system comprising: at least one support member positioned on a surface; a frame comprising an upper portion and a lower portion, the upper portion being coupled to the at least one support member; a barrier material coupled to and suspended between the upper portion and the lower portion, the barrier material forming an enclosure having an interior and an exterior, wherein the barrier material is spaced from the at least one support member; and a door positioned on the enclosure and configured to provide access to the interior of the enclosure, wherein the door comprises: a door base; at least one door support member comprising a vertical post configured for coupling to the door base and at least one curved extension extending from the vertical post; and at least one cable extending from the curved extension to the door base, wherein at least the upper portion of the frame is coupled to the at least one door support member via the cable and the barrier material is spaced from the at least one door support member of the door.

BRIEF DESCRIPTION OF THE DRAWINGS

Figure 1:
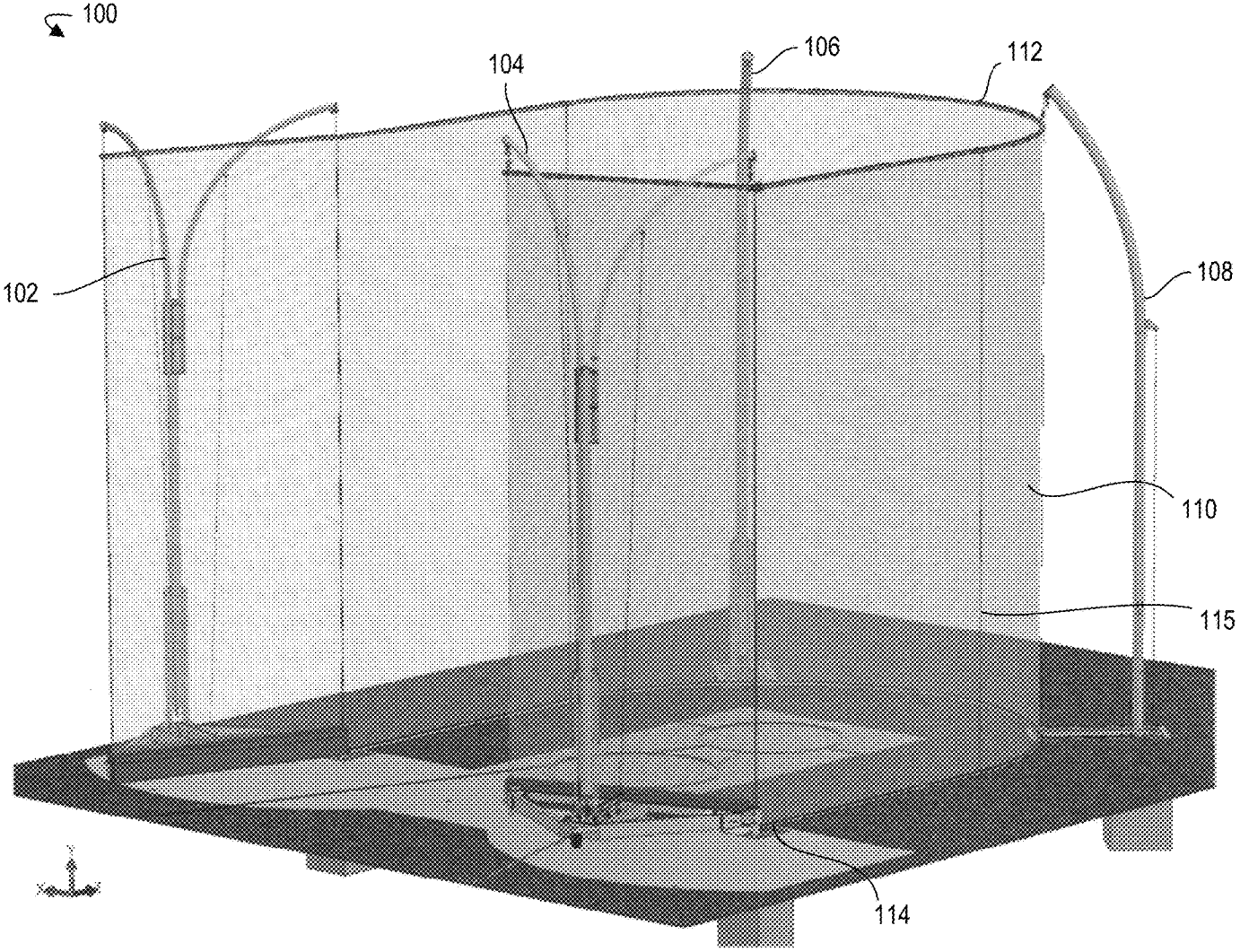
Figure 2:
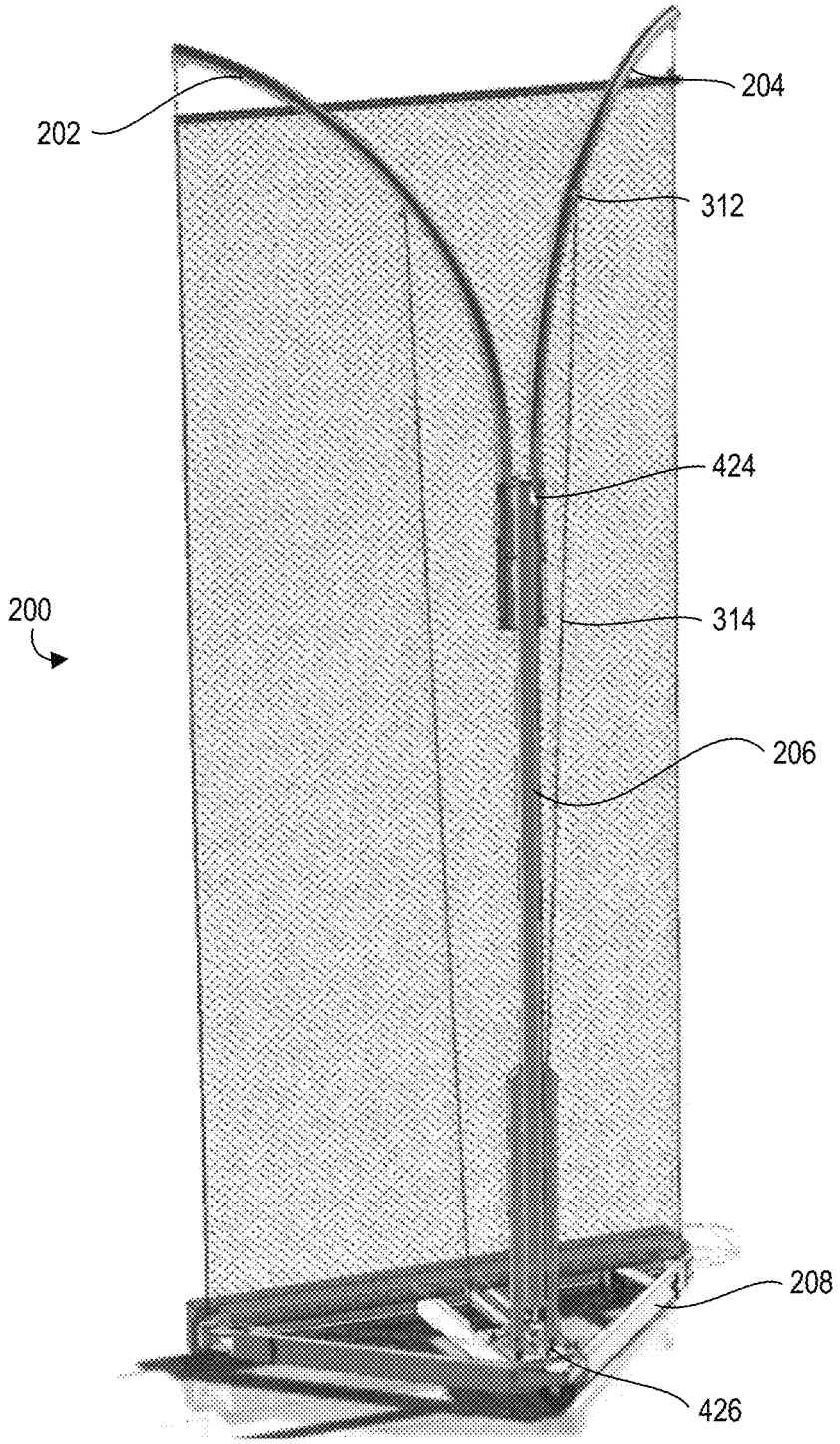
Figure 3A:
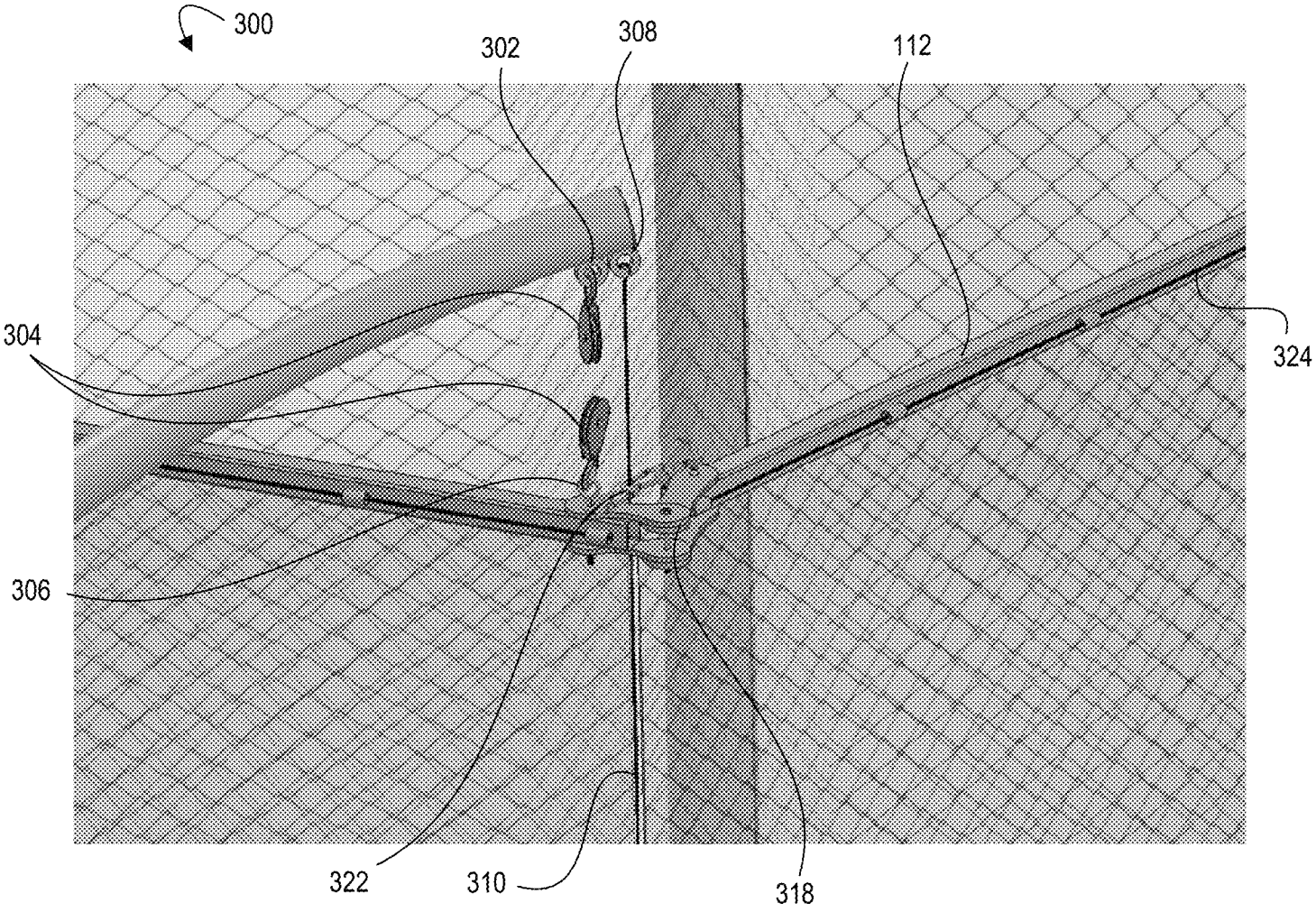
Figure 3B:
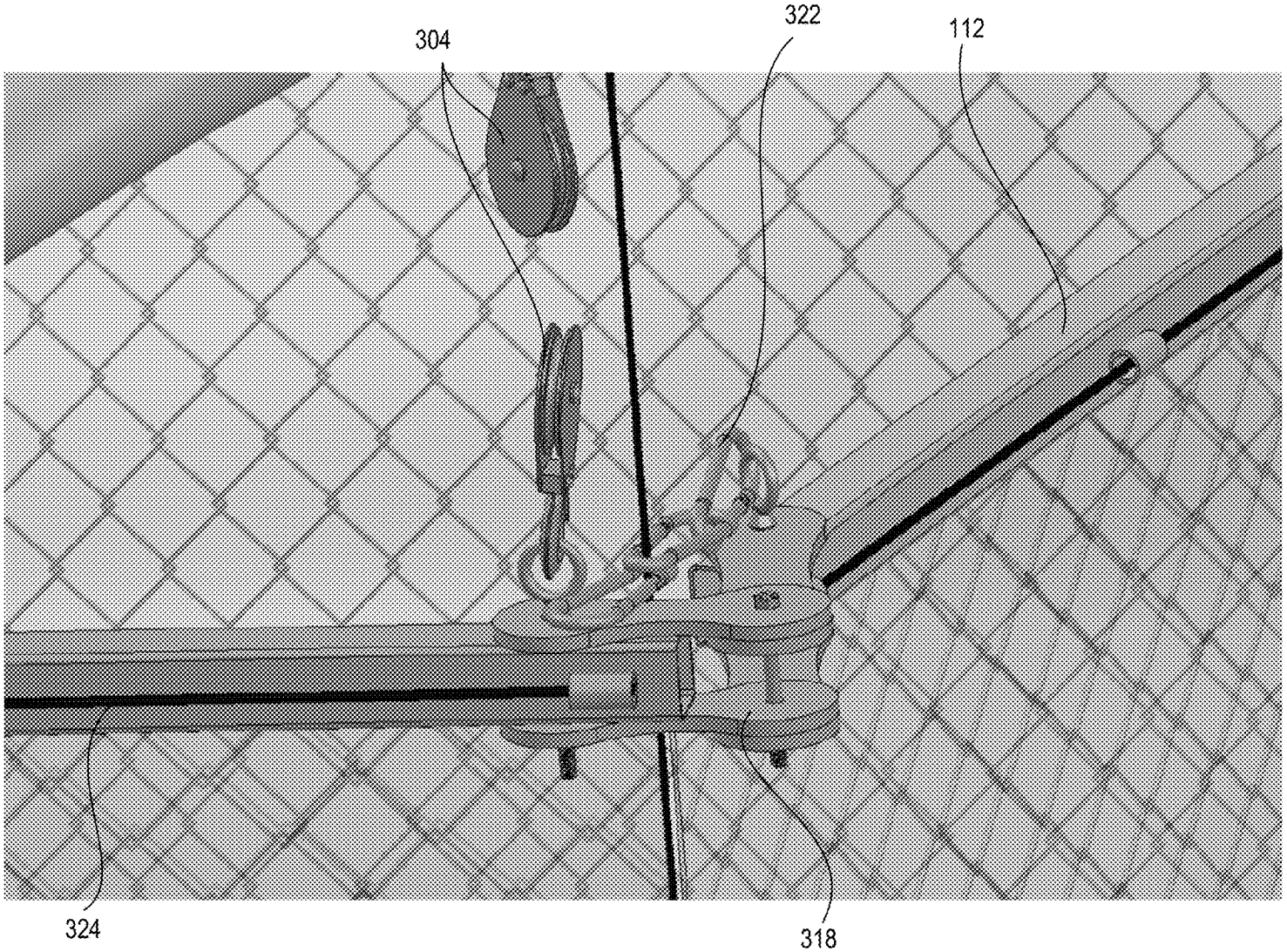
Figure 4A:
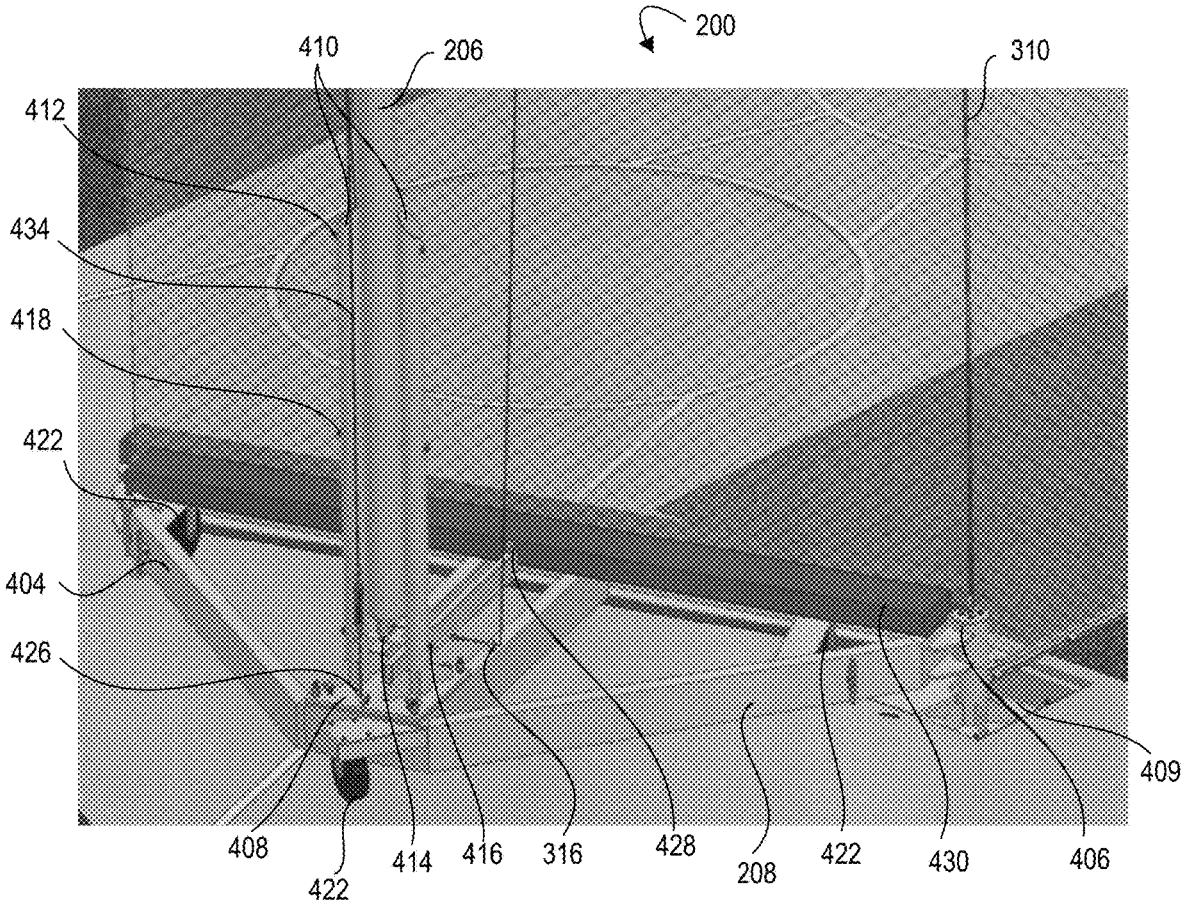
Figure 4B:
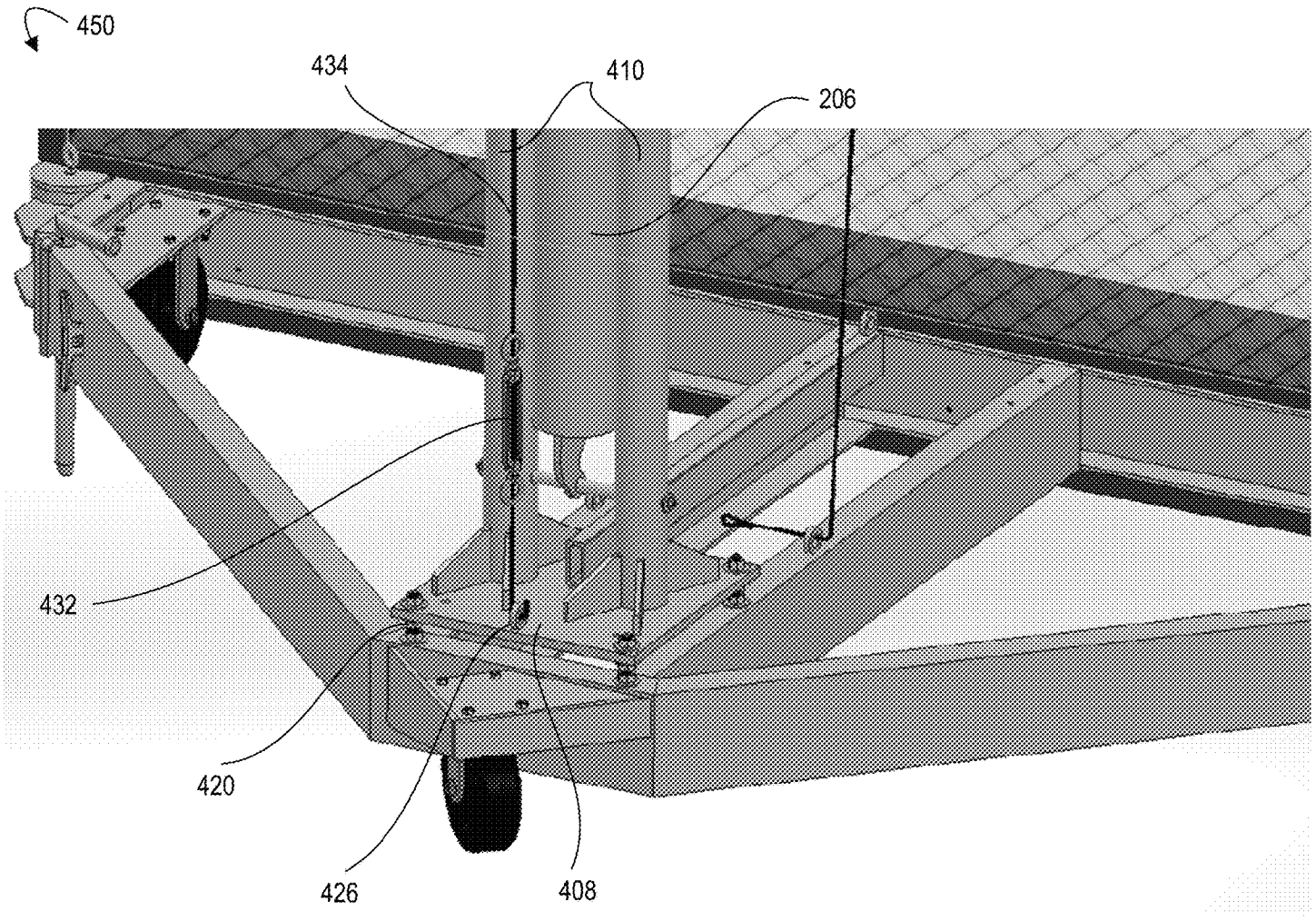
Figure 4C:
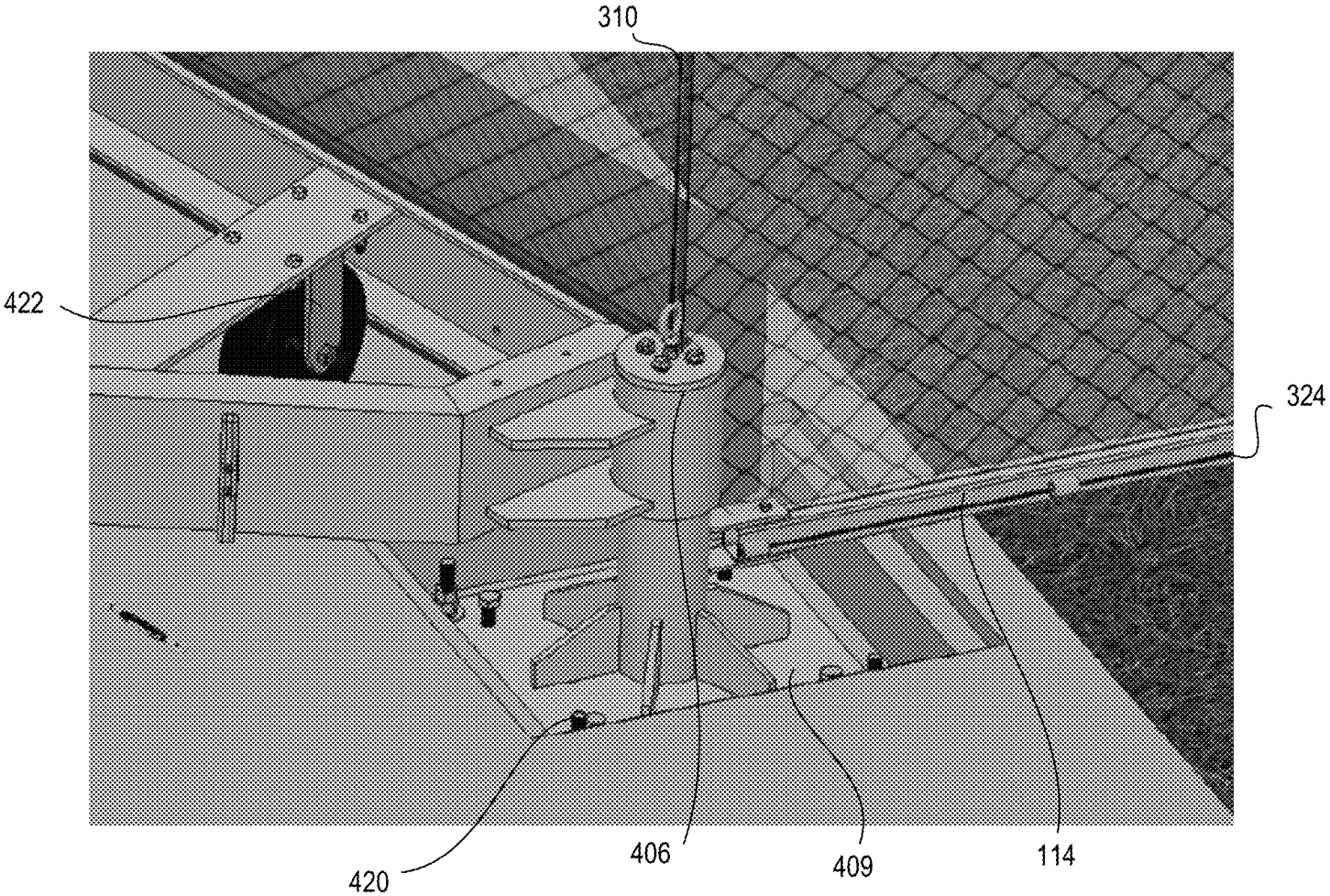
Figure 5:
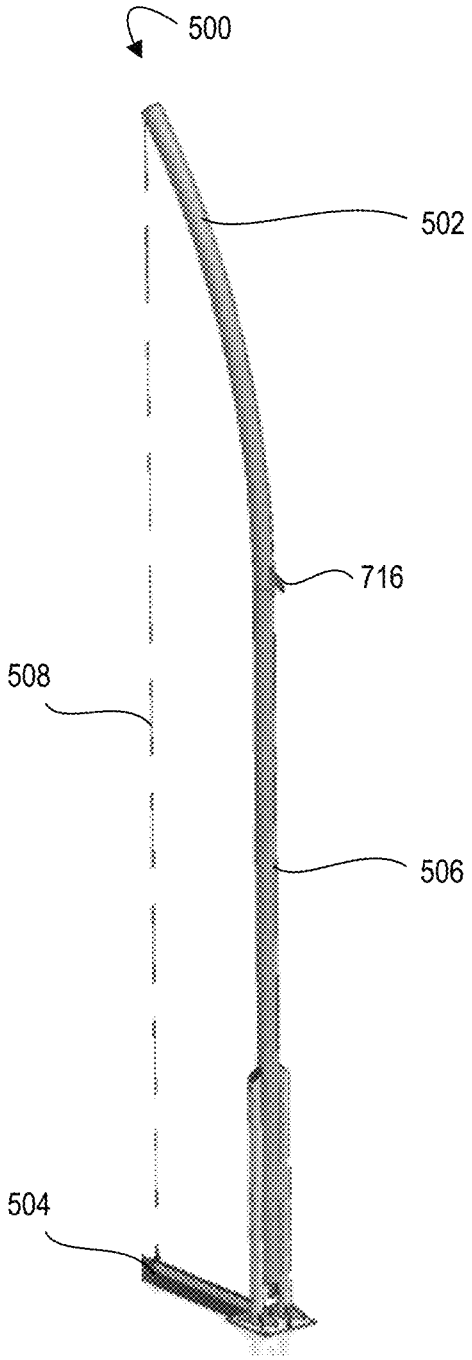
Figure 6:
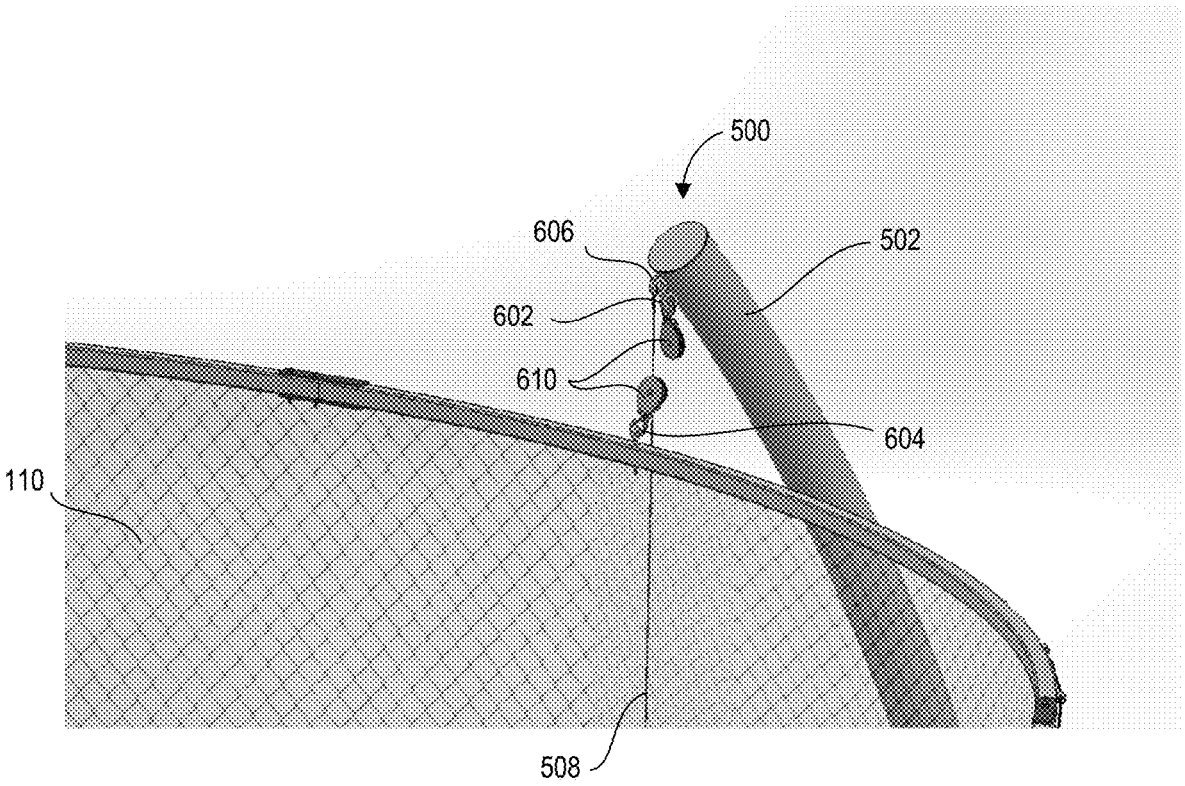
Figure 7:
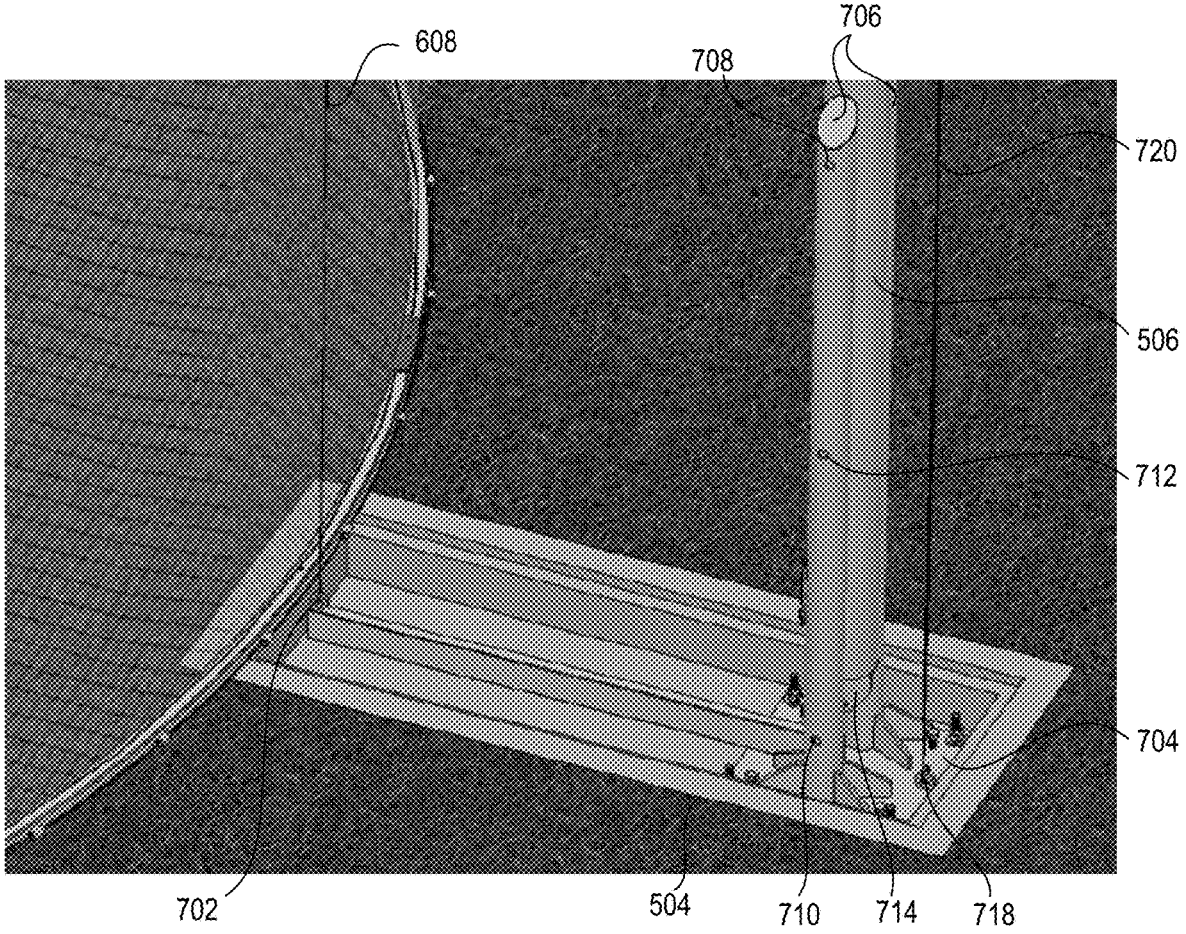
Figure 8:
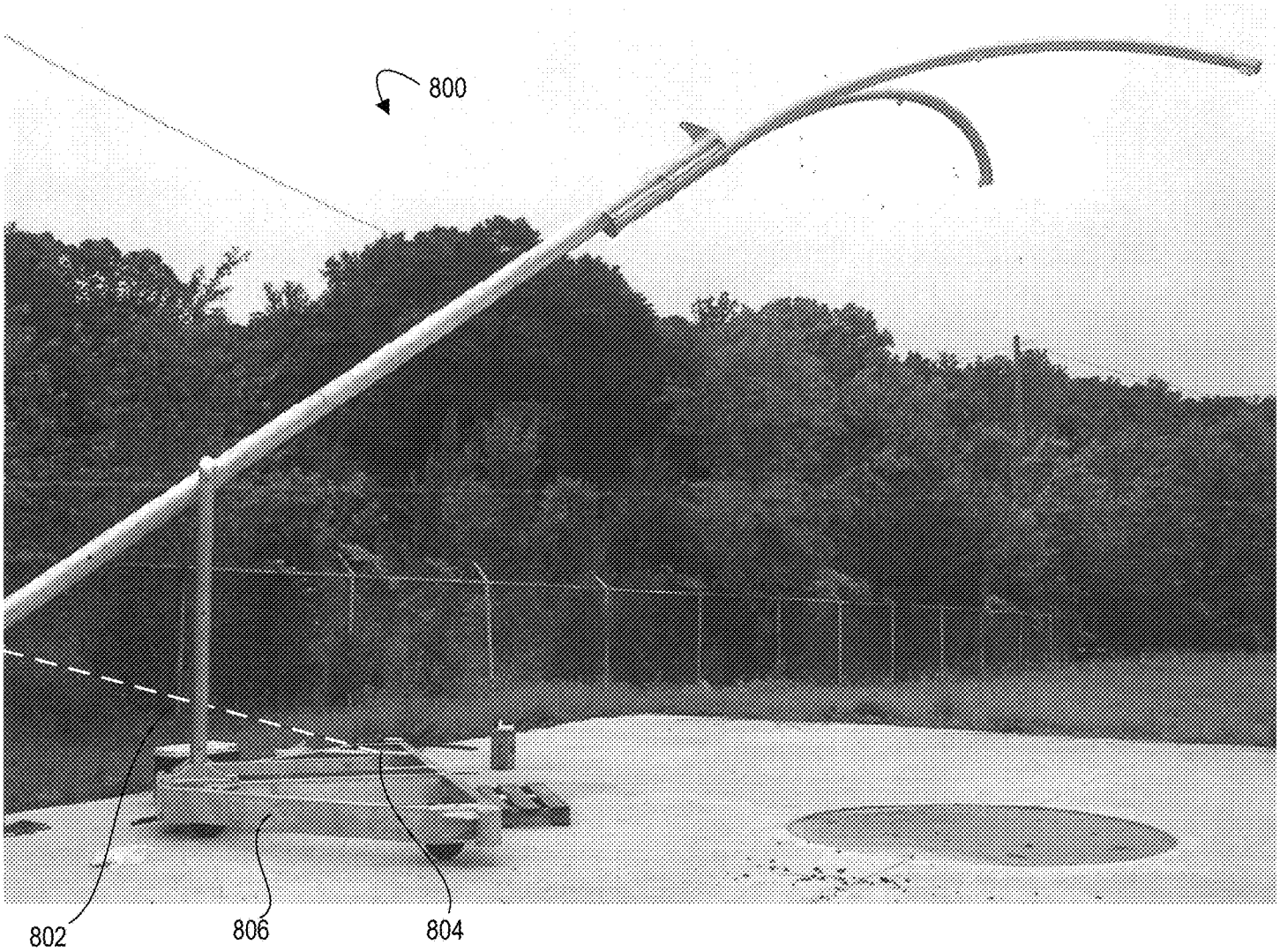
Figure 9A:
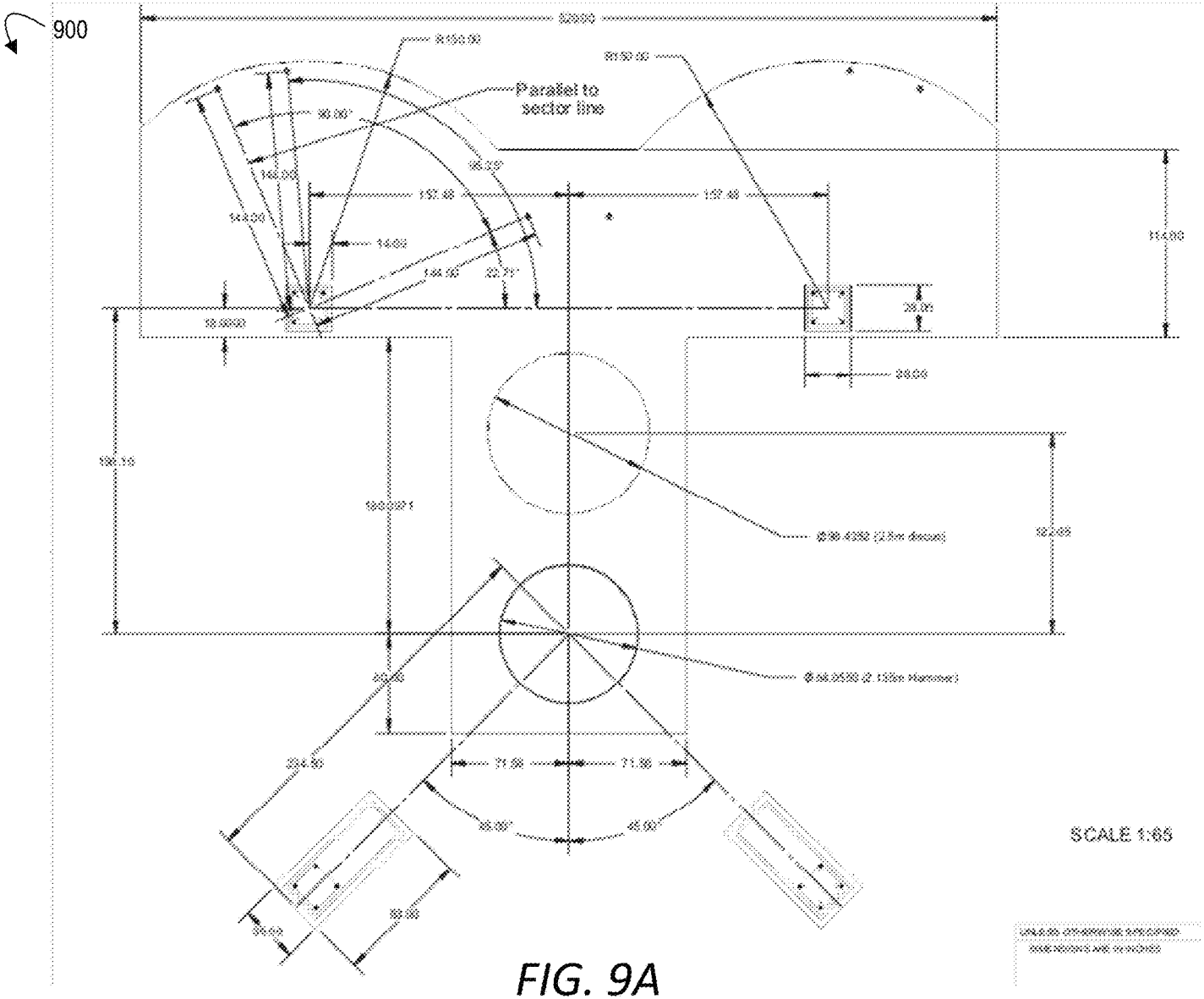
Figure 9B:
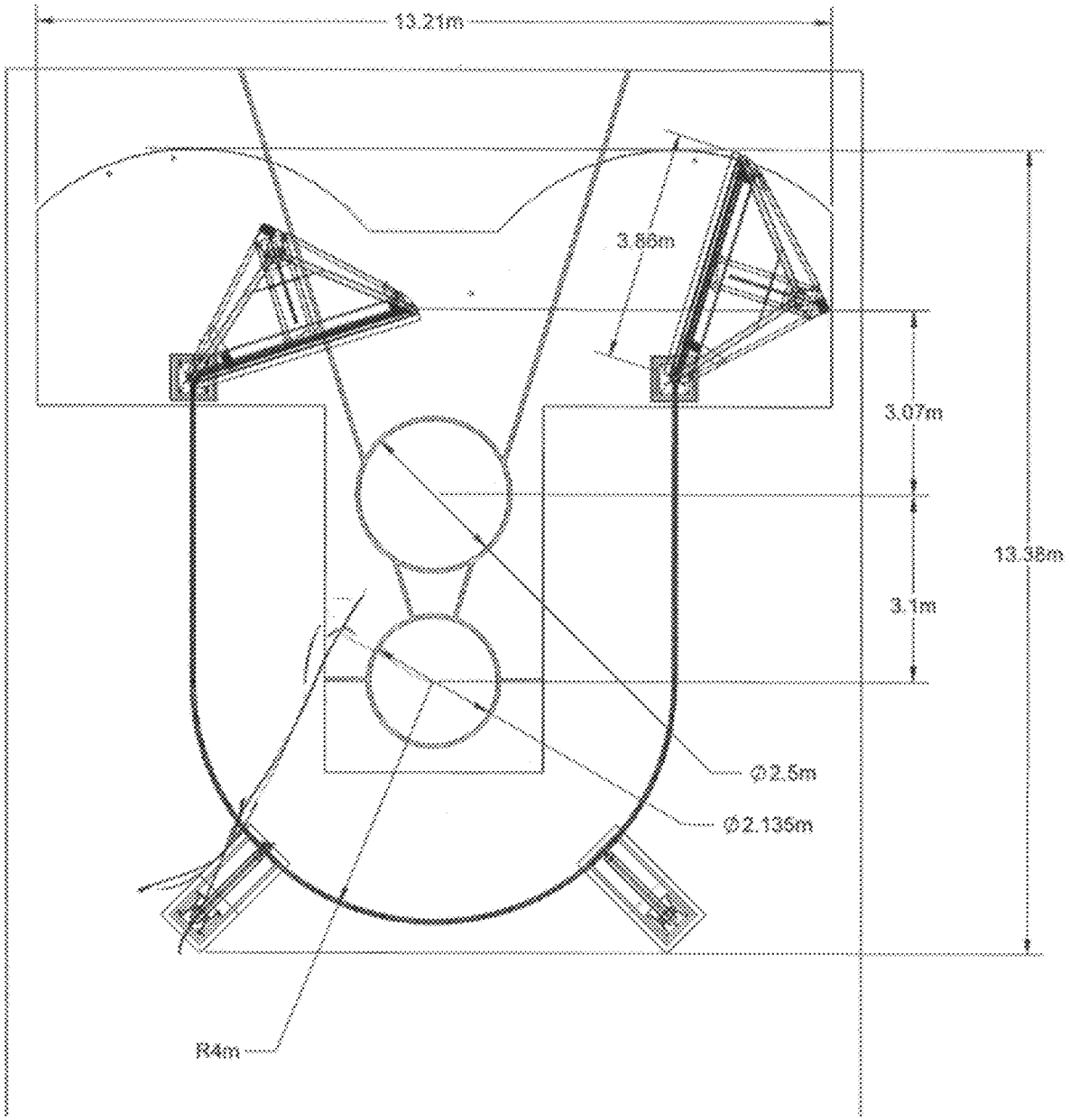
Figure 10:
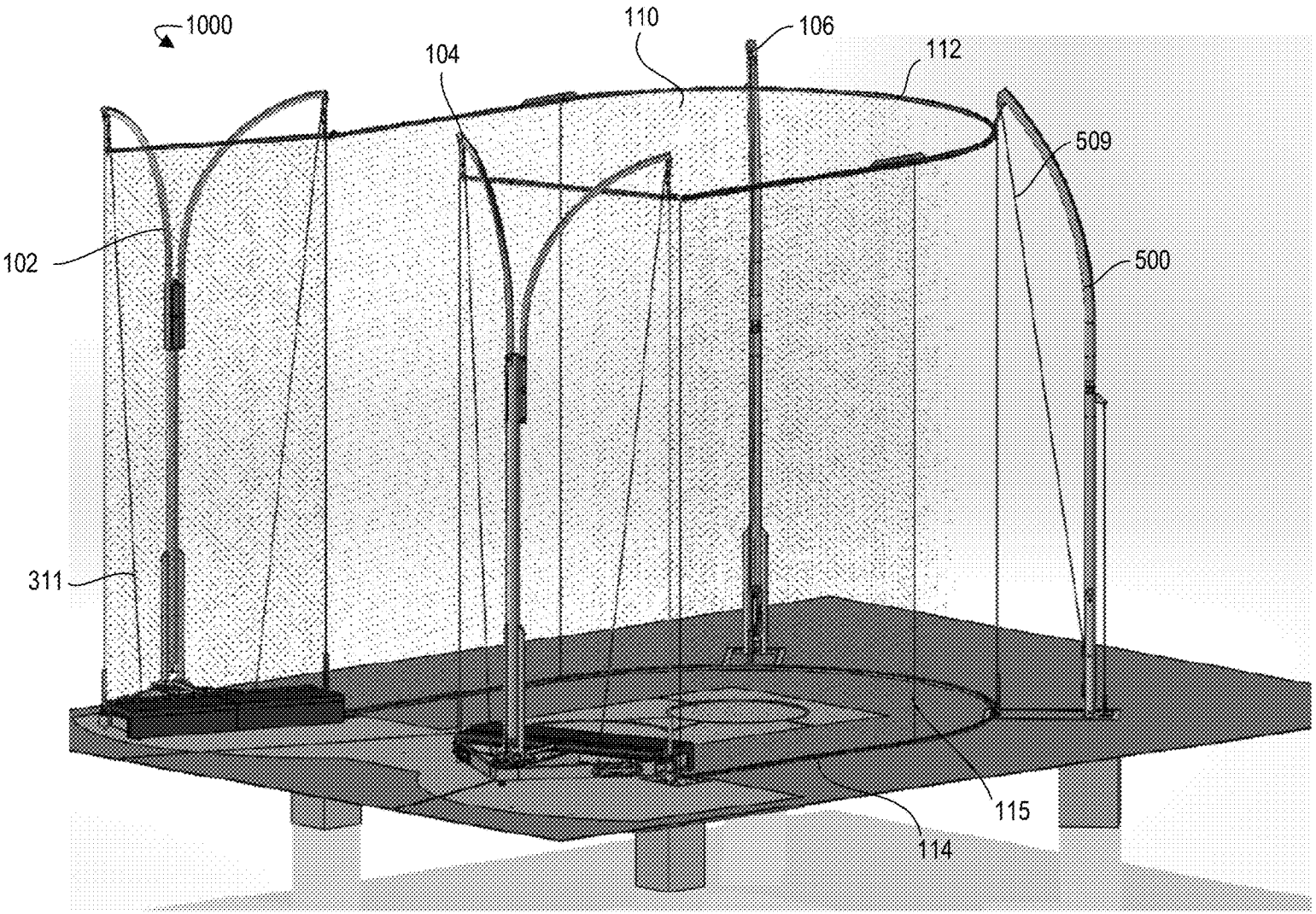
Figure 11:
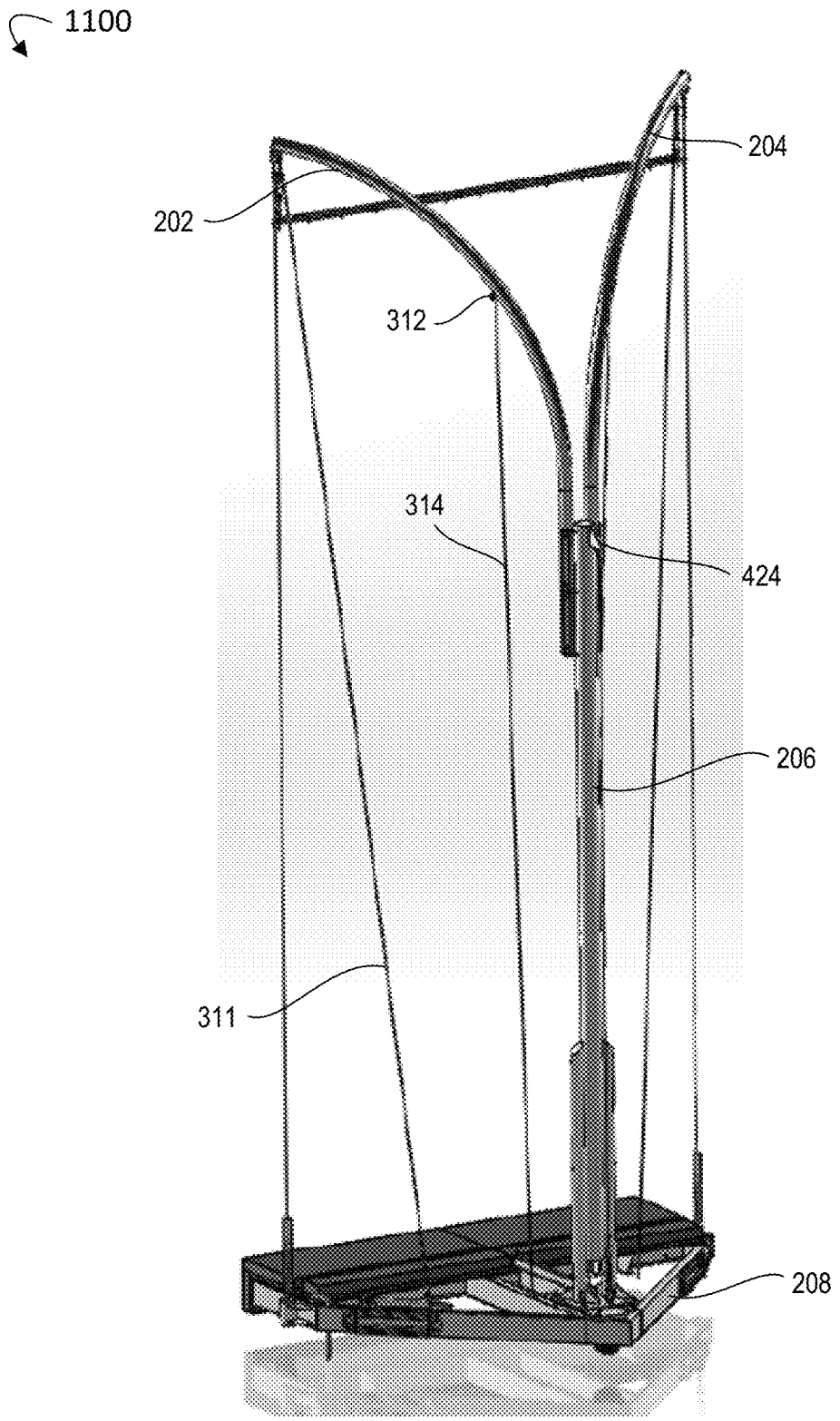
Figure 12:
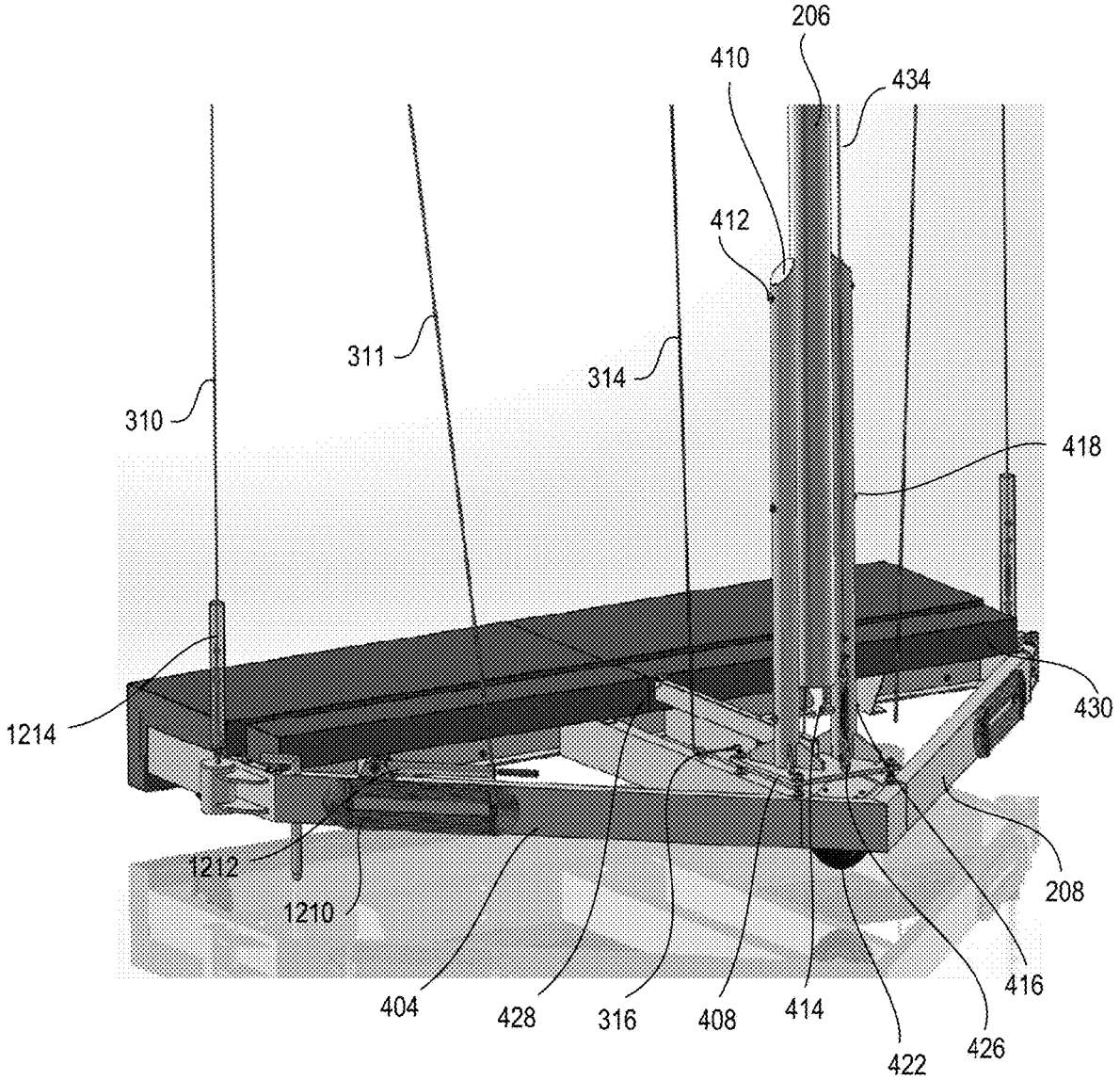
Figure 13:
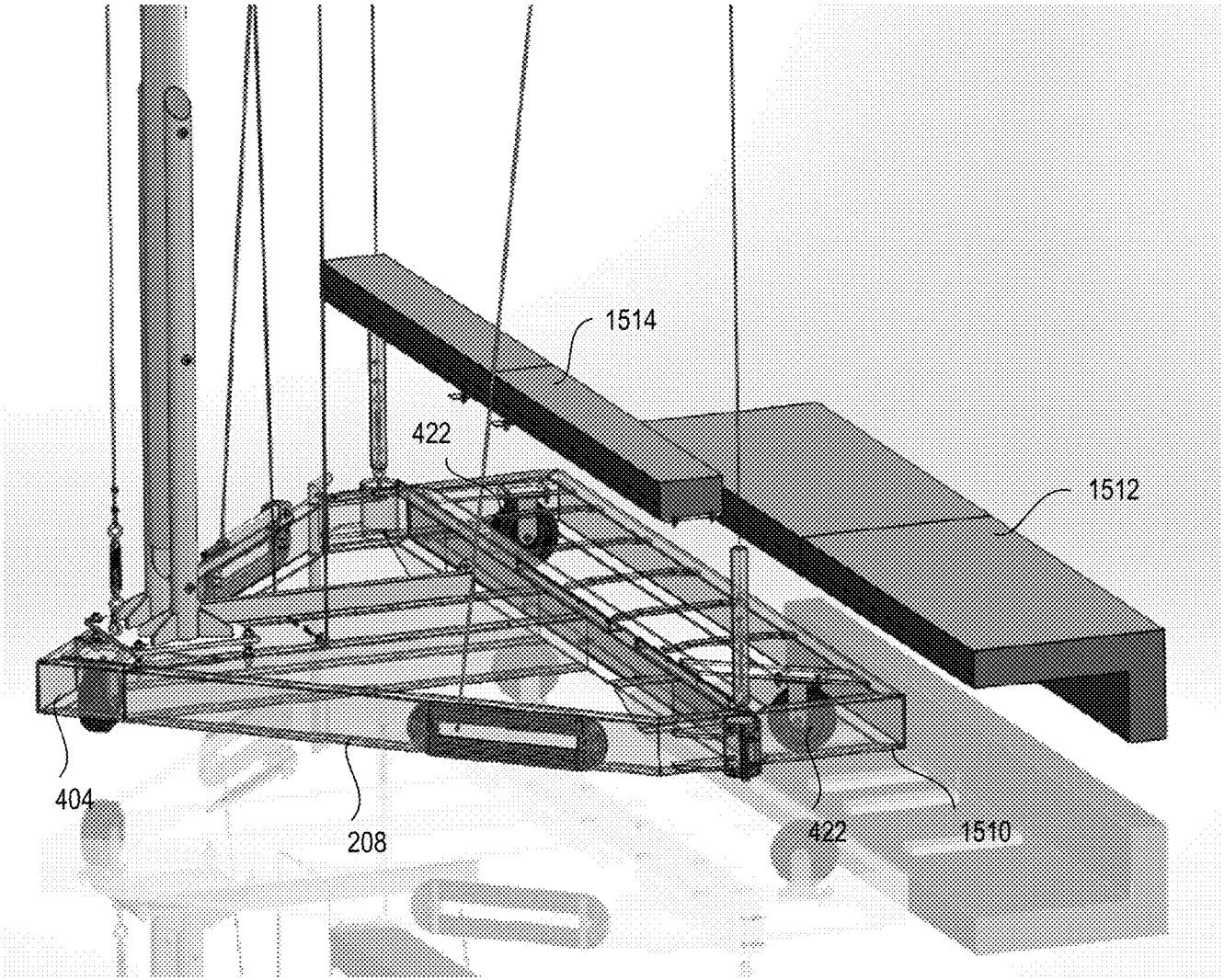
Figure 14:
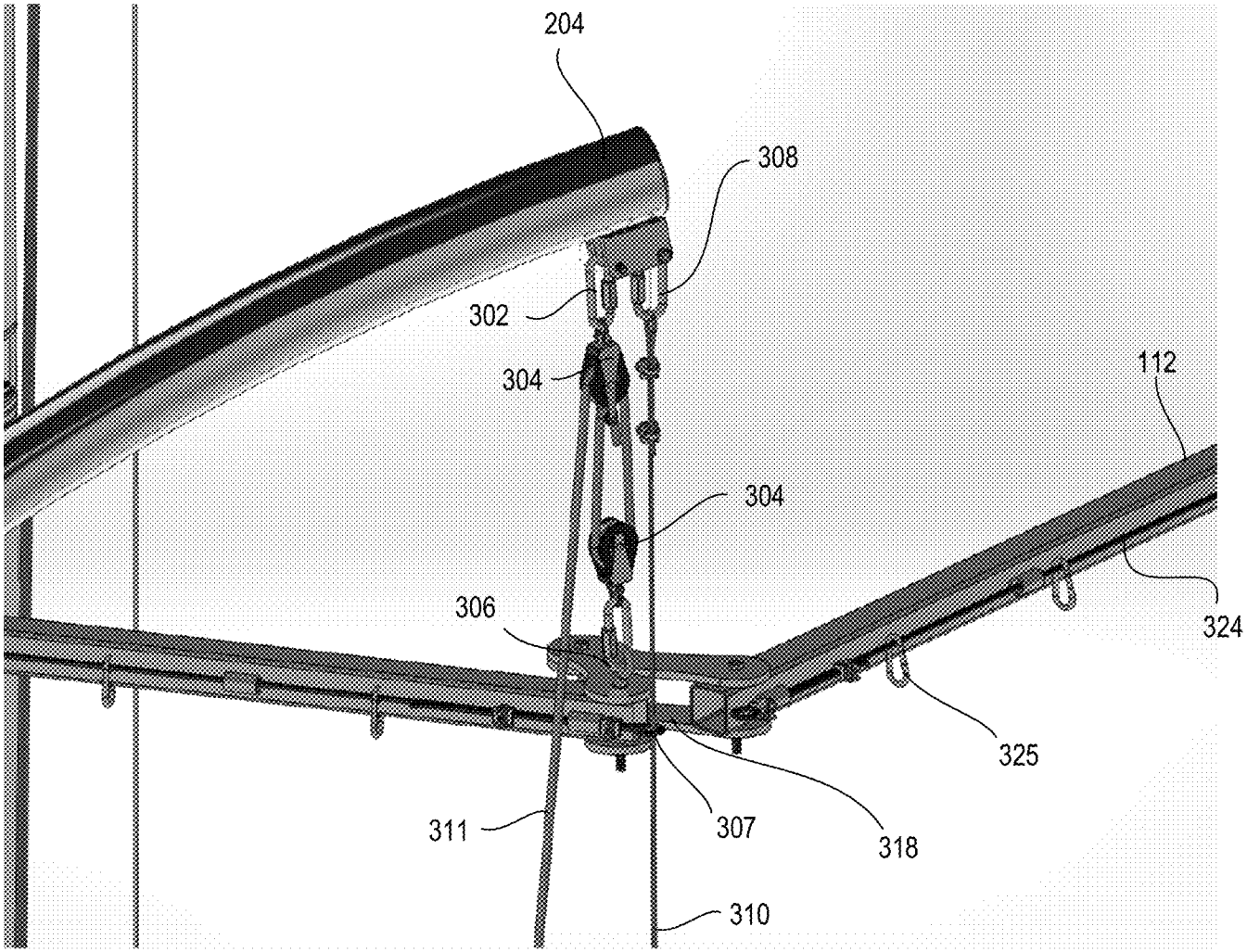
Figure 15:
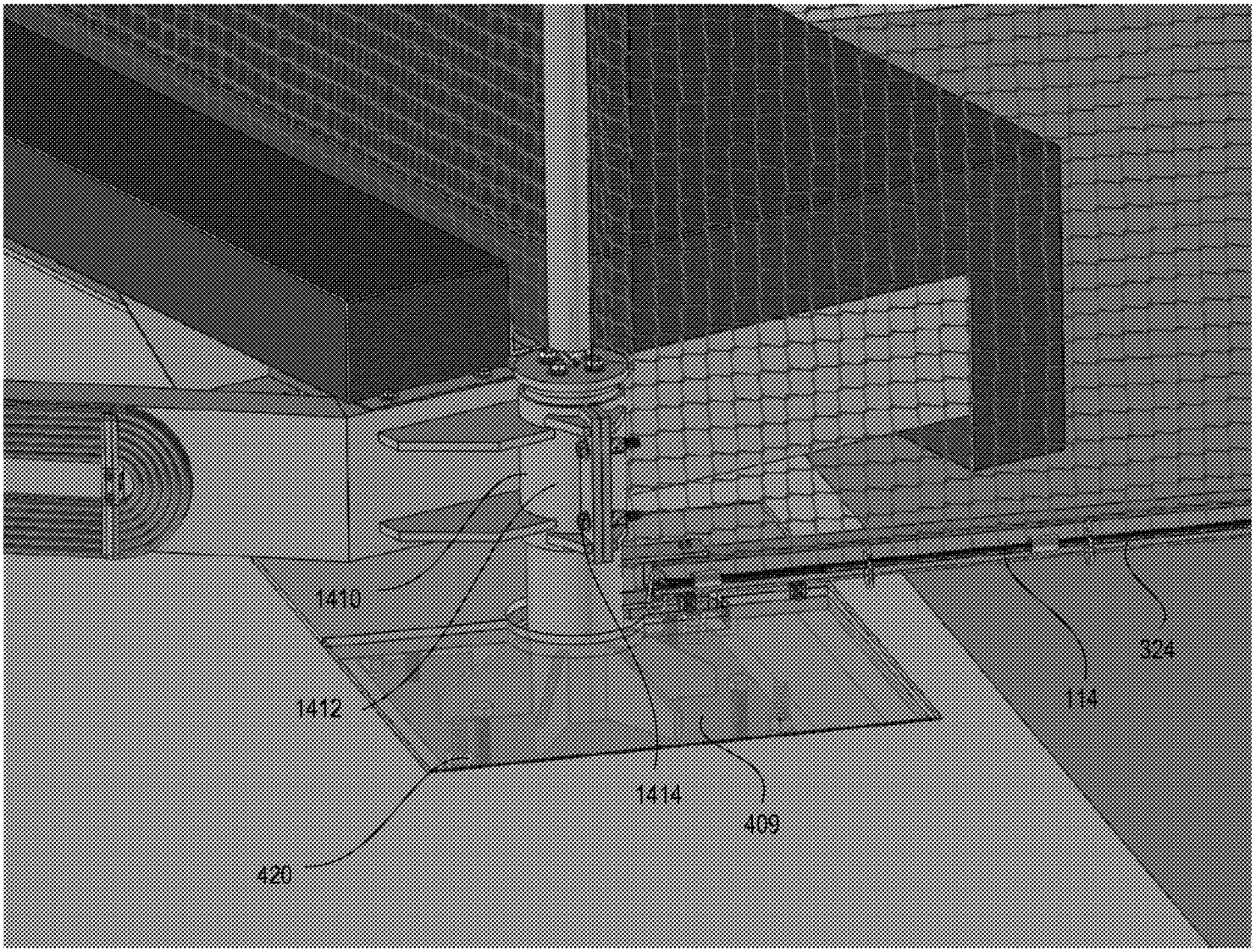
Figure 16:
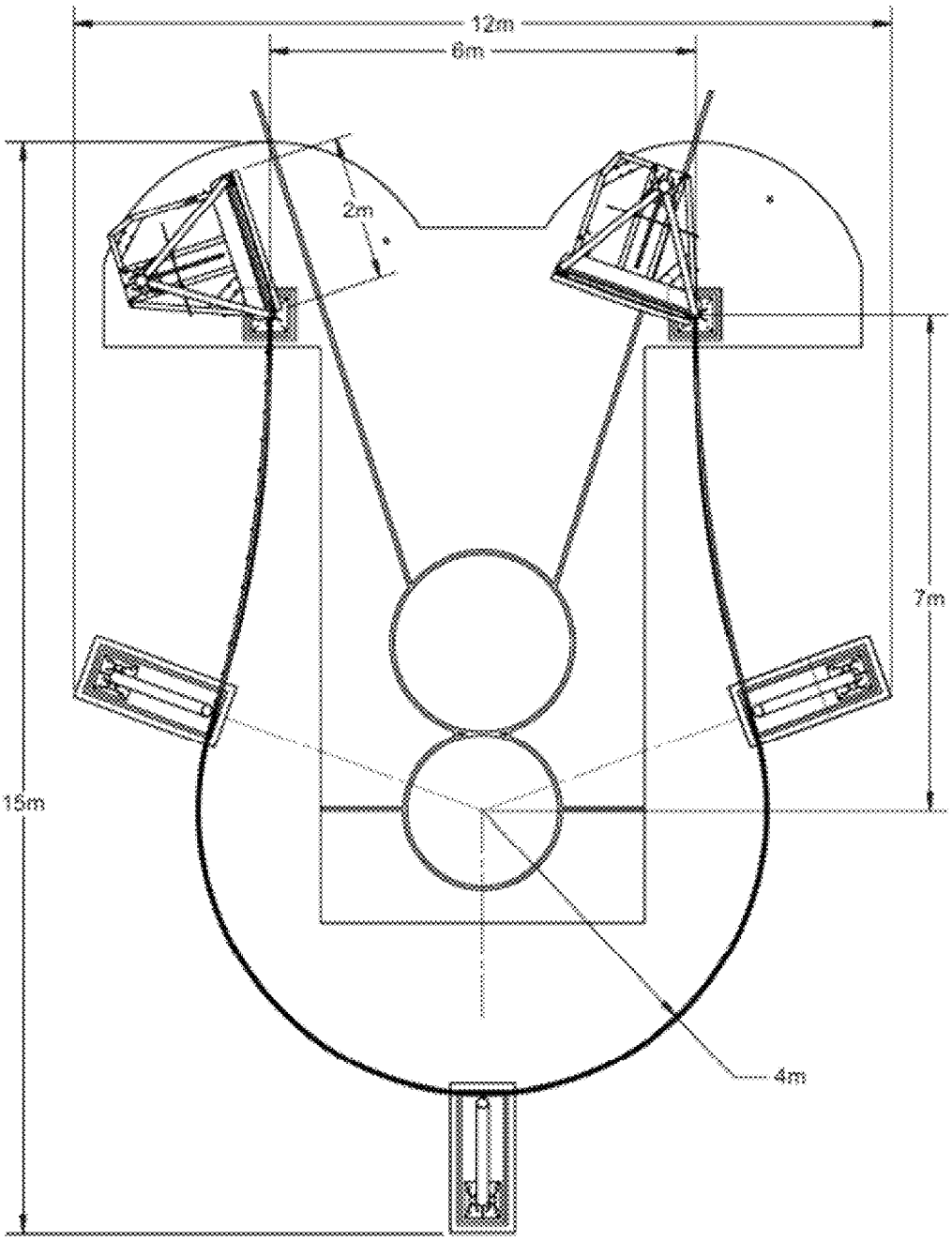

Having thus described embodiments of the invention in general terms, reference will now be made to the accompanying drawings, wherein:

FIG. 1 provides a perspective view of a protective barrier system, in accordance with one embodiment of the invention;

FIG. 2 provides a perspective view of a forked support member, in accordance with one embodiment of the invention;

FIG. 3A provides a detail view of an upper portion of a curved extension of a forked support member, in accordance with one embodiment of the invention;

FIG. 3B provides a detail view of a double hinged connection in accordance with one embodiment of the invention;

FIG. 4A provides a detail view of a base of a forked support member, in accordance with one embodiment of the invention;

FIG. 4B provides a detail view of an adjustable platform, in accordance with one embodiment of the invention;

FIG. 4C provides a detail view of a floating hinge, in accordance with one embodiment of the invention;

FIG. 5 provides a perspective view of a single support member, in accordance with one embodiment of the invention;

FIG. 6 provides a detail view of an upper portion of a curved extension of a single support member, in accordance with one embodiment of the invention;

FIG. 7 provides a detail view of a base of a single support member, in accordance with one embodiment of the invention;

FIG. 8 provides a view of a forked support member in an storage state, in accordance with one embodiment of the invention;

FIG. 9A provides a schematic overhead view of a protective barrier system installation surface, in accordance with one embodiment of the invention;

FIG. 9B provides a schematic overhead view of a protective barrier system, in accordance with one embodiment of the invention;

FIG. 10 provides a perspective view of a protective barrier system, in accordance with one embodiment of the invention;

FIG. 11 provides a perspective view of a forked support member, in accordance with one embodiment of the invention;

FIG. 12 provides a detail view of a base of a forked support member, in accordance with one embodiment of the invention;

FIG. 13 provides an exploded view of a wheel housing, in accordance with one embodiment of the invention;

FIG. 14 provides a detail view of a double hinged connection in accordance with one embodiment of the invention;

FIG. 15 provides a detail view of a floating hinge, in accordance with one embodiment of the invention; and FIG. 16 provides a schematic overhead view of a protective barrier system, in accordance with one embodiment of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. In the drawings, like reference characters and numbers refer to like elements throughout. Also, the drawings are not necessarily to scale, emphasis instead generally being placed upon illustrating the principles of the disclosure. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Embodiments of the present invention are directed to a protective barrier system for track and field events that safely contain misthrown projectiles (e.g., hammers and discus) with little to no damage to the structural integrity of the protective barrier while allowing for high visibility of an interior of the protective barrier by spectators observing from the exterior. The invention comprises a series of support members supporting a frame from which a barrier material (e.g., a net) may be suspended to define an enclosure. Cables act as a series of virtual posts which provide structural support and shape to the barrier material to prevent contact of the barrier material against the support members upon a stray projectile (e.g., a hammer or discus) striking the interior of the barrier. In this way, damage to the barrier material may be prevented and visibility of the interior event increased.

A "user," as used herein may refer to a beneficiary of the protective qualities of the protective barrier system. In some embodiments, the user may be an athlete competing in a track and field event (e.g., hammer throw or discus throw) who is contained within an interior enclosure of the protective barrier system. In some embodiments, the user may be a spectator positioned on the exterior of the protective barrier system who is observing another user, such as an athlete, compete within the interior of the protective barrier system. In some embodiments, the protective barrier system is for use in track and field events. In a specific example, the protective barrier system is a hammer and/or discus cage.

FIG. 1 provides a perspective view of an assembled protective barrier system 100, in accordance with one embodiments of the invention. The protective barrier system generally comprises at least one support member positioned on a surface. In the depicted embodiment, the protective barrier system comprises a first forked support member 102, a second forked support member 104, a first single (i.e., non-forked) support member 106, and a second single support member 108. The protective barrier system 100 further comprises a frame 111 which along with the various support members 102, 104, 106, 108 define an enclosure formed by a barrier material 110.

In the illustrated embodiment, first 102 and second 104 forked support members and the first 106 and second 108 single support members are positioned to form and support a curvilinear shape of the frame 111 with the attached barrier material 110, wherein the first 106 and second 108 single support members help define a curvature of a formed enclosure, while the first 102 and second 104 forked support members form doors positioned relative to the enclosure that are configured of at least partially closing off an opening of the enclosure. In a specific embodiment, the enclosure formed by the frame 111 and barrier material 110 is U-shaped, however, in other embodiments, one or more support members may be positioned to form alternative shapes having different (FIG. 16). In some embodiments, the protective barrier system 100 may comprise one or more additional support frames to provide support an enclosure covering a larger surface area. In yet other embodiments, the protective barrier system 100 comprises a fewer number of support members.

In the illustrated embodiment, the frame 111 comprises an upper portion 112 and a lower portion 114 which function as support bands for the barrier material 110. The barrier material 110 is operatively coupled to and suspended between the upper and lower portions 112, 114 of the frame 111 to form walls of the enclosure. The upper and lower portions 112, 114 are rigid or semi-flexible frames which provide shape and structure to the walls of the enclosure formed by the barrier material 110. The upper portion 112 is coupled to and suspended from upper ends of the support member 102, 104, 106, 108. The lower portion 114 is coupled to a base of the support members 102, 104, 106, 108 adjacent the surface. In one embodiment, the lower portion 114 is spaced from the surface. The lower portion 114 is configured to weights down a bottom end of the attached barrier material 110 and reduce undesired movement of the barrier material 110 (e.g., from wind) and retain a desire shape of the enclosure. In some embodiments, the support bands are lightweight, hollow channels or tubular members. In the illustrated embodiment, the upper and lower portions 112, 114 of the frame 11 have a square or rectangular cross section. In other embodiments, the support bands have a different cross sectional shape (e.g., a circle, triangle, S-shape, or the like). The frame 111 may be constructed from metal, plastics, composite materials, and/or combinations thereof.

In one embodiment, the frame 111 further comprises a plurality of vertical cables 115 extending between the upper portion 112 and the lower portion 114 and positioned adjacent the barrier material 110 on an exterior side of the enclosure. The plurality of vertical cables, along with the upper and lower portions 112, 114 provide shape and structure to the enclosure while acting as virtual posts which are described in detail below.

As illustrated in FIG. 3A, FIG. 3B, and FIG. 4C, lateral support cables 324 are operatively coupled to a perimeter of each of the upper and lower portions 112, 114. The lateral support cables are configured to allow for attachment of the barrier material 110 to the frames 111 on which to operatively couple the barrier material 110. In one embodiment, the barrier material 110 is coupled to the lateral support cables 324 by one or more attachment mechanisms 325 (e.g., carabiners or fixed attachment points) positioned along the length of the lateral support cables 324 (FIG. 14). In the illustrated embodiment, the lateral support cables 324 are positioned to an exterior-facing side of the frame 111, wherein the barrier material 110 is coupled to the lateral support cables 324 and the upper and lower portions 112, 114 are positioned within the enclosure formed by the barrier material 110. By positioning the barrier material 110 on an exterior side of the upper and lower portions 112, 114 of the frame 111, forceful contact between the barrier material 110 and the frame 111 experienced when a thrown object (e.g., a hammer or discus) strikes the enclosure may be reduced. The barrier material 110 coupled to an exterior side of the upper and lower portions 112, 114 will flex outward, away from the frame 111 instead of being brought into further contact with the frame 111 if the barrier material 110 were alternatively positioned on an interior side. In an alternative embodiment, a lateral cable 324 is positioned within a channel formed by a portion of the frame 111.

As previously discussed, a barrier material 110 is suspended from the frame 111 of the protective barrier system 100 to define an enclosure having an interior and an exterior. The suspended barrier material 110 is suspended at least somewhat vertically to form a continuous wall around an interior of the enclosure. In some embodiments, the barrier material 110 is a net, fence, or similar open-meshed fabric or material constructed from a polymer, metal, and/or other material that may be twisted, knotted, woven, or bonded together at regular intervals that may allow for an observer or spectator positioned on the exterior of the enclosure to at least partially view the interior of the enclosure through the barrier material 110. The barrier material 110 may comprise a material having a high stress and/or strain resistance that can withstand multiple impacts from weighted objects (e.g., a hammer or discus) while maintaining structural integrity and shape. In some embodiments, the barrier material 110 may be a net comprising a material having a minimized diameter that maximizes visibility of the interior of the protective barrier for one or more spectators on the exterior of the protective barrier. In a specific embodiment, the barrier material 110 is constructed from ultra-high molecular weight polyethylene (UHWPE).

As illustrated in FIG. 1, the first and second forked support members 102, 104 and suspended barrier material 110 form doors positioned on the enclosure and providing access to an interior of enclosure of the protective barrier system 100 while simultaneously forming extensions of the walls. For example, one or more of the doors may be configured in an open position to allow for an object to be thrown by a user from the interior of the protective barrier to a designated area of the exterior of the protective barrier. While FIG. 1 provides a perspective view of an assembled protective barrier system 100 in a configuration with one of the two doors open (e.g., for use during a hammer throw event), the protective barrier system 100 may also be configured with both doors open (e.g., for use during a discus throw event).

FIG. 2 provides a perspective view of a forked support member 200, in accordance with one embodiment of the invention. The forked support member comprises a first curved extension 202 and a second curved extension 204 that are operatively coupled to a vertical post 206, the vertical post 206 being operatively coupled to a base 208 of the forked support member 200 positioned on a surface. In the illustrated embodiment, the first curved extension 202 and the second curved extension 204 are not parallel. In an alternative embodiments, the first curved extension 202 and the second curved extension 204 are parallel. The structure of the forked support member 200 is discussed in detail below.

FIG. 3A provides a detail view of an upper portion of a curved extension 300 of a forked support member 200, in accordance with one embodiment of the invention. The upper portion of the curved extension 300 comprises one or more eyelets operatively coupled to the upper portion. In the illustrated embodiment, a first eyelet 302 is used to operatively couple the curved extension 300 to the upper portion 112 of the frame 111. In some embodiments, the support member 200 and the frame 111 may be operatively coupled with a tensioned cable 311 or the like via one or more pulleys 304 operatively coupled to each of the first eyelet 302 and a corresponding eyelet 306 or the like operatively coupled to the upper portion 112 of the frame 111 (FIG. 14).

In the illustrated embodiment, a second eyelet 308 is used to operatively couple the curved extension 300 to the base 208 of the same forked support member 200 via a vertical cable 310 or the like. The vertical cable 310 is typically positioned on an exterior side or in-line with the barrier material 110 to provide structure, shape, and support to the barrier material while further preventing the barrier material 110 from coming into contact with the various support members when the barrier material 110 is struck back by the force of an object contacting the interior of the enclosure. The barrier material 110 may degrade, fail, or rupture due to excessive contact with a rigid, solid object such as the support members thereby reducing the protective effectiveness of the protective barrier system 100. The vertical cable 310 may be tensioned using a tensioning tool or the like to provide additional structure and resistive capacity to the walls of the enclosure. In this way, the vertical cable 310 acts as a virtual post for the protective barrier system 100 in that the vertical cable 310 provides structure and shape to the walls of the barrier, while remaining flexible and not providing a point of contact for which the barrier material 110 may strike contact the support members. Additionally, the virtual posts do not excessively obstruct the view of the interior of the enclosure to the extent that a traditional post would, thereby allowing for increased visibility of a user within the enclosure. In the illustrated embodiment, the barrier material 110 is supported by a plurality of virtual posts where thicker, more rigid metal posts or beams might be typically placed. Furthermore the greater flexibility of the virtual posts when compared to traditional post constructions allows for an impact force experienced from an object striking the enclosure to be spread out over the surface area of the barrier material 110. Additionally, the more flexible virtual posts allow for the construction of smooth, continuous shapes for the enclosure than allowed by traditional post systems.

In one embodiment, a third eyelet 312 (as seen in FIG. 2) may be positioned approximately midway down the length of a curved extension (e.g., second curved extension 204) which is operatively coupled via a secondary vertical cable 314 to the base of the same forked support member 200 via a base eyelet 316 (as seen in FIG. 4A). The secondary vertical cable 314 is similarly tensioned to act as a secondary virtual post for the barrier material 110 and prevent the barrier material 110 from contacting the forked support member. As a horizontal component of the direction of extension of the curved extensions 202, 204 is not perpendicular to the surface of the barrier material 110, vertical cable 314 may be used as a secondary virtual post to further prevent the barrier material 110 from contacting portions of the forked support member 200 as a result of being struck back by a force from a contacting object. For example, an object may strike the barrier material 110 at a position between the curved extensions 202, 204 of the forked support member 200, wherein the barrier material 110 is forced back toward vertical post 206. In this example, vertical cables 314 provide a secondary virtual post to catch the barrier material 110 and prevent contact with the forked support member 200 which comprises portions not directly in-line with vertical cables 310.

As illustrated in FIG. 3A, in accordance with one embodiment, the upper portion 112 of the frame 111 further comprises a hinge (e.g., a double hinged connection 318) positioned and operatively coupled between the door formed by the forked support member 200 and the enclosure to allow for the door to be repositionable between an open state and a closed state and thereby provide or deny access to an interior of the enclosure. FIG. 3B provides a detail view of a double hinged connection 318 in accordance with one embodiment of the invention. The double hinged connection 318 comprises three operatively coupled, pivoting axes spanning a gap in the upper portion 112 of the frame 111 to allow the door to move relative to the enclosure. In some embodiments, the gap of the frame 111 is also spanned and coupled by one or more attachment mechanisms 322 (e.g., carabiners or the like) which provide additional structure to the double hinged connection 318 by restricting a maximum opening angle of the hinge. Furthermore, by passing the vertical cable 310 through an opening of the attachment mechanism 322, the attachment mechanism 322 further acts to separate and protect the vertical cable 310 and prevent it from contacting the double hinged connection 318. Repeated contact of the vertical cable 310 or barrier material 110 with the double hinged connection 318, the support members, or other hard surfaces could cause degradation and eventual structural failure of the vertical cable 310 or barrier material 110, thereby reducing the structural integrity and protective effectiveness of the barrier system 100 as a whole. In an alternative embodiment, vertical cable 310 passes through a loop 307 (FIG. 14) formed by an end of a portion of the lateral support cable 324, wherein passing the vertical cable 310 through the loop 307 assists in aligning the frame 111 with the support member 200, providing shape and structure to the enclosure, and preventing the vertical cable 310 from contacting the hinge 318.

FIG. 4A provides a detail view of a base of a forked support member 200, in accordance with one embodiment of the invention. The base 208 comprises a base frame such as triangular frame 404 as illustrated in the figure. It should be understood that while a triangular-shaped frame is preferred to provide proper weight distribution of the support member 200, other frame shapes are contemplated herein. The triangular frame 404 further comprises a floating hinge 406 and adjustable platform 408 operatively coupled to the triangular frame 404. In the illustrated embodiment, the triangular frame 404 further comprises padding 430 operatively coupled to the triangular frame 404 adjacent the barrier material 110. In one embodiment, the padding 430 is positioned on an interior side of the enclosure.

FIG. 4B provides a detail view of an adjustable platform, in accordance with one embodiment of the invention. The adjustable platform 408 receives and supports the vertical post 206 with one or more arms 410 used to operatively couple the vertical post 206 and the adjustable platform 408. As seen in FIG. 4A, the arms 410 are operatively coupled to the vertical post 206 via a first rod 412 which passes through the arms 410 and vertical post 206 allowing the vertical post 206 to pivot about the first rod 412 and to be configured in a substantially horizontal position relative to the ground while the protective barrier system 100 is in an unassembled or storage state (FIG. 8). A hooked protrusion 414 is positioned at the bottom of the vertical post 206 and is configured to receive and couple a second rod 416 of the arms 410 when the vertical post 206 is pivoted from a horizontal position to a vertical position. A cable 806 (FIG. 8) may be attached between the hooked protrusion 414 and a forward eyelet 428 of the triangular frame 404, wherein the cable may be tensioned to assist in raising the vertical post 206 from the horizontal position to the vertical position. The vertical post 206 may be secured in the vertical position with a removable pin 418 placed through aligning holes of the arms 410 and the vertical post 206. The adjustable platform 408 is operatively coupled to the triangular frame 404 via a plurality of threaded rods 420, screws, bolts, or the like which may be individually adjusted to finely tune a height of the vertical post 206 from the surface. In this way, tension of the barrier material 110 supported by the various support members may be precisely optimized to eliminate or reduce sagging or unevenness of the barrier material 110.

The vertical post 206 additionally has a rear eyelet 424 (as seen in FIG. 2) which is configured to operatively couple the vertical post 206 to a corresponding rear eyelet 426 on the triangular frame 404 via a cable 434 which may be tensioned backwards to provide an opposing force to the support member 200 and balance a force experienced due to supporting the weight of the frame 111, barrier material 110, and the like. As previously discussed, a tensioning tool 432 is configured to tighten and loosen the various cables described herein.

FIG. 4C provides a detail view of a floating hinge 406, in accordance with one embodiment of the invention. The floating hinge 406 receives the vertical cable 310, as previously discussed with respect to FIG. 3A and FIG. 3B, to create a hinge for the forked support member 200 to pivot about when being repositioned between an open state and closed state. The floating hinge 406 may be operatively coupled to the surface via one or more bolts or screws. The triangular frame 404 further comprises one or more wheels 422 operatively coupled to the triangular frame 404 for moving the door formed by the forked support member 200 about the floating hinge 406 relative to the enclosure to open or close said door. In one embodiment, the wheels 422 are positioned to allow the door to travel in a predetermined, arced pathway between the open and closed positions. In an alternative embodiment, the wheels 422 pivotably coupled to the frame 404. The floating hinge 460 may further include an adjustable platform 409 system (similar to the adjustable platform 408) integrated into the bottom of the floating hinge 406 where the floating hinge 406 is operatively coupled to the surface. The adjustable platform 409 when integrated into the bottom of the floating hinge 406 allows for further fine tuning and optimization of the height of the individual support members and tension of the barrier material 110. The floating hinge 406 may further be operatively coupled to the lower portion 114 of the frame 111 to provide support for the lower portion 114.

FIG. 5 provides a perspective view of a single (i.e., not forked) support member 500, in accordance with one embodiment of the invention. The single support member 500 is typically a stationary frame member with a base 504 operatively coupled to the surface via one or more screws, bolts, or the like. Similar to the forked support members described herein, the single support member 500 comprises a vertical post 506; however, unlike the forked support member, the single support member 500 only has a single curved extension 502 operatively coupled to the vertical post 506. Preferably, the single support member 500 is positioned where a horizontal component of the direction of extension of the curved extension 502 is perpendicular to the surface of the barrier material 110 so that a vertical cable 508 may be configured as a virtual post which prevents contact between the barrier material 110 and the single support member 500.

FIG. 6 provides a detail view of an upper portion of a curved extension 502 of a single support member 500, in accordance with one embodiment of the invention. The upper portion of the single curved extension 502 comprises one or more eyelets operatively coupled to the upper portion. In the illustrated embodiment, a first eyelet 602 is used to operatively couple the curved extension 502 to the upper portion 112 of the frame 111. In some embodiments, the support member 500 and the frame 111 may be operatively coupled with a tensioned cable 509 or the like via one or more pulleys 610 operatively coupled to each of the first eyelet 602 and a corresponding eyelet 604 or the like operatively coupled to the upper portion 112 of the frame 111 (FIG. 10).

A second eyelet 606 may be used to operatively couple the upper portion of the single curved extension 502 to the base of the single support member 500 via a vertical cable 508 or the like. The vertical cable 508 is positioned behind or in line with the barrier material 110 to provide structure, shape, and support for the barrier material and prevent the barrier material 110 from coming into contact with the various support members upon the barrier material 110 being struck back by the force of a contacting object. The vertical cable 608 may be tensioned using a tensioner, puller, or the like to provide additional structure to the walls of the protective barrier system. In this way, the vertical cable 608 acts as a virtual post for the protective barrier system. As the single support member 500 is positioned where a horizontal component of the direction of extension of the curved extension 502 is perpendicular to the surface of the barrier material 110, a second vertical cable is not necessarily required to sufficiently protect the barrier material 110. In an alternative embodiment, a second vertical cable may be used as a secondary virtual cable to further protect the barrier material 110 from contact with the support member 500.

FIG. 7 provides a detail view of a base of a single support member 500, in accordance with one embodiment of the invention. The base 504 has a forward eyelet 702 operatively coupled to the base 504 that is configured for receiving and attaching the vertical cable 508. The single support member 500 has a rear eyelet 716 (as seen in FIG. 5) which is used to operatively couple the vertical post 506 of the single support member 500 to a corresponding rear eyelet 718 with a cable 720. Additionally, cable 720 may be tensioned backwards to provide an opposing force to the support member 500 to balance a force experienced from supporting the weight of the frame 111, barrier material 110, and the like. Furthermore, the single support member 500 comprises an adjustable platform 704, one or more arms 706, a first rod 708, a second rod 710, a removable pin 712, and a hooked protrusion 714 similar in function to those components of the forked support member 200 previously described herein.

FIG. 8 provides a view of a forked support member 800 in a storage state, in accordance with one embodiment of the invention. As previously discussed with respect to FIG. 4A, a cable 802 may be attached between the hooked protrusion (not shown) and a forward eyelet 804 of the triangular frame 806, wherein the cable 802 may be tensioned to assist in raising the vertical post 206 from a horizontal storage position to a vertical position. The forked support member 800 is raised to the vertical position for attachment of the frame 111 and barrier material 110 while an assembly of the protective barrier system 100 is performed. Alternatively, the forked support member 800 may also be brought from the vertical state to the horizontal state in the same manner to allow for a more convenient form factor for transportation and/or storage.

FIG. 9A provides a schematic overhead view of a protective barrier system installation surface 900, in accordance with one embodiment of the invention. In some embodiments, the support members are installed in designated positions, concrete footings, or foundations to maintain consistent spatial relationships to one another for a precise installation of the protective barrier system 100 that conforms to a predetermined or regulated design. In one embodiment, a footing or foundation comprises a drainage duct and/or holes to guide liquid out of the footing or foundation and a surrounding surface or ground. In some embodiments, a specific design, layout, or configuration may be required by a regulating entity of an event (e.g., NCAA, IOC, or the like). In some embodiments, the installation surface is a concrete surface as illustrated in FIG. 9A. FIG. 9A further discloses dimensions and spatial relationships between the various support members and components of the system to one another as well as the installation surface itself. An installed protective barrier system 100 is further disclosed with respect to FIG. 9B which provides a schematic overhead view of an assembled protective barrier system 100, in accordance with one embodiment of the invention.

In a specific embodiment of the invention, an approximate length, width, and height of the assembled protective barrier system 100 is approximately 13 meters, 7.5 meters, and 9 meters respectively, wherein the floating hinges 406 of the first and second forked support members 102, 104 are spaced approximately 7.5 meters apart and the distance from the floating hinge 406 of the first forked support member 102 to the base 504 of the first single support member 106 is approximately 8.5 m.

Referring now to FIGS. 10-15, an alternative embodiment of the protective barrier system 1000 is presented. It should be noted that the alternative embodiment 1000 discussed with respect to FIGS. 10-15 has similar features to the protective barrier system 100 of FIGS. 1-9B unless stated otherwise.

As illustrated in the alternative embodiment, cable 311 is used to operatively couple frame 111 to the forked support member 200. Cable 311 is fed through pulley system 304 to operatively couple the upper portion 112 of the frame 111 to an end of the curved extension 204 via eyelets 302 and 306. Cable 311 is then attached to the triangular frame 404 of the base 208 at a cable attachment point 1210. In the illustrated embodiment, the cable attachment point 1210 comprises a structure configured for winding and collecting an excess length of the cable 311 following tensioning of the cable 311. Similar to cable 311 of forked support member 200, cable 509 of the single support member 500 may similarly be configured to travel through pulley system 604 to operatively couple the frame 111 to the single support member 500, wherein the cable 509 is attached to the base 504 at a similar cable attachment point.

The portions of the cables 311 and 509 extending down from pulley systems 304 and 604, respectively, may be employed as secondary virtual posts and provide further protection for preventing contact between the barrier material 110 and the support members 200, 500. It should be noted that even though vertical cable 314 is depicted in FIGS. 11 and 12, in a specific embodiment, vertical cable 314 is not required as cable 311 may either replace or supplement the function of cable 314 as a secondary virtual post.

As illustrated in FIG. 12, one or more of the cables, for example vertical cable 310, may have tubing 1214 positioned along a length of the cables, wherein the tubing 1214 is configured to surround at least a portion of the cable in order to provide additional protection to the barrier material 110 and the cables by preventing contact (e.g., rubbing, catching, or the like) between the barrier material 110 and the cables. In some embodiments, the tubing 1214 is positioned over hardware attached to the cables which might catch and damage the barrier material 110. For example, tubing may be placed around a portion of a cable having a clamp used to secure a loop formed from the cable.

As illustrated in FIG. 14, in an alternative embodiment, floating hinge 406 further comprises a band clamp 1410, the band clamp 1410 comprising a band 1412 encircling an exterior portion of the hinge 406 and a tightening mechanism 1414 configured for adjusting a tightness of the hinge. In this way, a force required for pivoting the door about the hinge 406 and repositioning the door between an open position and a closed position can be adjusted.

As illustrated in FIG. 15, in an alternative embodiment, door base 208 further comprises a wheel housing 1510 operatively coupled to the door base 208 forward of the barrier material 110 on an interior side of the enclosure. Wheels 422 are operatively coupled to a bottom surface of the wheel housing 1510 and are configured for traveling along the surface during repositioning of the door (i.e., a forked support member 200) between an open state and a closed state. By positioning the wheels 422 and wheel housing 1510 forward of the barrier material 110, a center of gravity of the door is shifted to better accommodate the weight of the door and the forked support member 200 and prevent tipping of the door during movement. The door base 208 further comprises a handle 1212 operatively coupled to the triangular frame 404 to assist a user in repositioning the door. The handle 1212 is configured to pivot down and collapse against the frame 404 to be positioned in a storage position (FIG. 12).

The door base 208 further comprises a first padding member 1512 operatively coupled to a surface of the wheel housing 1510, the first padding member 1512 covering the wheel housing 1510 on the interior side of the enclosure. The door base 208 further comprises a second padding member 1514 operatively coupled to the triangular frame adjacent the barrier material 110 on an exterior side of the enclosure. The first padding member 1512 and the second padding member 1514 cover portions of the door base 208 to prevent damage resulting in contact with the door base 208 (e.g., user or equipment contact).

In one embodiment, a protective barrier system is provided, the protective barrier system comprising: at least one support member configured for coupling to a surface; a frame comprising an upper portion and a lower portion, the upper portion being coupled to the at least one support member; a barrier material coupled to and suspended between the upper portion and the lower portion of the frame, the barrier material forming an enclosure having an interior and an exterior; and a door positioned relative to the enclosure and configured to provide access to the interior of the enclosure, wherein the barrier material is spaced from the at least one support member; and wherein the frame provides shape and structure to the barrier material.

In one aspect, the at least one support member comprises a vertical post configured for coupling to a base and at least one curved extension extending from the vertical post.

In another aspect, alone or in combination with any one of the previous aspects or any combination thereof, the at least one support member is positioned on an exterior side of the enclosure.

In another aspect, alone or in combination with any one of the previous aspects or any combination thereof, the door comprises at least one door support member comprising a vertical post configured for coupling to a door base and at least one curved extension extending from the vertical post, wherein at least an upper portion of the frame is coupled to the at least one door support member and the barrier material is spaced from the at least one door support member of the door.

In another aspect, alone or in combination with any one of the previous aspects or any combination thereof, the at least one door support member comprises a forked support member forming the door, the forked support member comprising a first curved extension and a second curved extension.

In another aspect, alone or in combination with any one of the previous aspects or any combination thereof, the at least one door support member comprises: a first cable connected between the first curved extension and the door base; and a second cable connected between the second curved extension and the door base.

In another aspect, alone or in combination with any one of the previous aspects or any combination thereof, the first curved extension and the second curved extension of the at least one door support frame do not extend parallel to each other.

In another aspect, alone or in combination with any one of the previous aspects or any combination thereof, the protective barrier system further comprises at least first and second doors located opposite of each other, wherein each door is independently positionable between an open state and a closed state.

In another aspect, alone or in combination with any one of the previous aspects or any combination thereof, the door is operatively coupled to the lower portion of the frame with a hinge, wherein the door is configured to be positioned between an open state and a closed state.

In another aspect, alone or in combination with any one of the previous aspects or any combination thereof, the hinge comprises a band clamp configured for adjusting a tightness of the hinge.

In another aspect, alone or in combination with any one of the previous aspects or any combination thereof, the door base comprises a wheel housing comprising wheels operatively coupled to the door base forward of the barrier material on an interior side of the enclosure, the wheels being configured for traveling along the surface during a repositioning of the door. In yet another embodiment, the door base further comprises padding covering the wheel housing on the interior side of the enclosure.

In another aspect, alone or in combination with any one of the previous aspects or any combination thereof, the at least one support member further comprises a vertical cable extending from the at least one curved extension to the base, wherein the vertical cable is configured to prevent the barrier material from contacting the forked support member.

In another aspect, alone or in combination with any one of the previous aspects or any combination thereof, the vertical cable comprises tubing positioned along a length of the vertical cable, the tubing configured to prevent contact between the barrier material and the vertical cable.

In another aspect, alone or in combination with any one of the previous aspects or any combination thereof, the frame further comprises a plurality of vertical cables extending between the upper portion and the lower portion, the plurality of vertical cables positioned adjacent the barrier material on an exterior side of the enclosure.

In another aspect, alone or in combination with any one of the previous aspects or any combination thereof, each of the upper portion and the lower portion of the frame comprises a lateral support cable operatively coupled to an exterior-facing side of the upper portion and the lower portion, wherein the barrier material is operatively coupled to the frame with one or more attachment mechanisms along the lateral support cable.

In another aspect, alone or in combination with any one of the previous aspects or any combination thereof, the frame has a curvilinear shape. In another aspect, alone or in combination with any one of the previous aspects or any combination thereof, the frame is U-shaped.

In another aspect, alone or in combination with any one of the previous aspects or any combination thereof, the barrier material is a net, fence, or mesh. In yet another embodiment, the barrier material comprises ultra-high molecular weight polyethylene.

In another aspect, alone or in combination with any one of the previous aspects or any combination thereof, the base comprises a height adjustment mechanism configured for adjusting the height of the vertical post from the surface.

In another aspect, alone or in combination with any one of the previous aspects or any combination thereof, the protective barrier system further comprises a foundation formed in the surface, wherein the at least one support member is operatively coupled to the foundation.

In another embodiment, a protective barrier system is also provided, the protective barrier system comprising: at least one support member positioned on a surface; a frame comprising an upper portion and a lower portion, the upper portion being coupled to the at least one support member; a barrier material coupled to and suspended between the upper portion and the lower portion, the barrier material forming an enclosure having an interior and an exterior, wherein the barrier material is spaced from the at least one support member; and a door positioned on the enclosure and configured to provide access to the interior of the enclosure, wherein the door comprises at least one door support member comprising a vertical post configured for coupling to a door base and at least one curved extension extending from the vertical post, wherein at least the upper portion of the frame is coupled to the at least one door support member and the barrier material is spaced from the at least one door support member of the door, wherein the frame provides shape and structure to the barrier material.

In yet another embodiment, a protective barrier system is also provided, the protective barrier system comprising: at least one support member positioned on a surface; a frame comprising an upper portion and a lower portion, the upper portion being coupled to the at least one support member; a barrier material coupled to and suspended between the upper portion and the lower portion, the barrier material forming an enclosure having an interior and an exterior, wherein the barrier material is spaced from the at least one support member; and a door positioned on the enclosure and configured to provide access to the interior of the enclosure, wherein the door comprises: a door base; at least one door support member comprising a vertical post configured for coupling to the door base and at least one curved extension extending from the vertical post; and at least one cable extending from the curved extension to the door base, wherein at least the upper portion of the frame is coupled to the at least one door support member via the cable and the barrier material is spaced from the at least one door support member of the door.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A protective barrier system comprising:

at least one support member configured for coupling to a surface, the at least one support member comprising:

a vertical post configured for coupling to a base;

at least one curved extension extending from the vertical post; and a vertical cable extending from the at least one curved extension to the base;

a frame comprising an upper portion and a lower portion, the upper portion being coupled to the at least one support member;

a barrier material coupled to and suspended between the upper portion and the lower portion of the frame, the barrier material forming an enclosure having an interior and an exterior; and a door positioned relative to the enclosure and configured to provide access to the interior of the enclosure, wherein the barrier material is spaced from the at least one support member, wherein the vertical cable is configured to prevent the barrier material from contacting the at least one support member, and wherein the frame provides shape and structure to the barrier material.

2. The protective barrier system of claim 1, wherein the at least one support member is positioned on an exterior side of the enclosure.

3. A protective barrier system comprising:

at least one support member configured for coupling to a surface;

a frame comprising an upper portion and a lower portion, the upper portion being coupled to the at least one support member;

a barrier material coupled to and suspended between the upper portion and the lower portion of the frame, the barrier material forming an enclosure having an interior and an exterior; and a door positioned relative to the enclosure and configured to provide access to the interior of the enclosure, the door being formed by a door support member comprising:

a vertical post configured for coupling to a door base;

a forked support member extending from the vertical post and comprising a first curved extension and a second curved extension;

a first cable connected between the first curved extension and the door base; and a second cable connected between the second curved extension and the door base, wherein the upper portion of the frame is coupled to the door support member, wherein the barrier material is spaced from the at least one support member and the door support member, and wherein the frame provides shape and structure to the barrier material.

4. The protective barrier system of claim 1, wherein the door is a first door, and the protective barrier system further comprises a second door located opposite of the first door, wherein the first door and the second door are independently positionable between an open state and a closed state.

5. The protective barrier system of claim 1, wherein the door is operatively coupled to the lower portion of the frame with a hinge, wherein the door is configured to be positioned between an open state and a closed state.

6. The protective barrier system of claim 5, wherein the hinge comprises a band clamp configured for adjusting a tightness of the hinge.

7. The protective barrier system of claim 3, wherein the door base comprises a wheel housing comprising wheels operatively coupled to the door base forward of the barrier material on an interior side of the enclosure, the wheels being configured for traveling along the surface during a repositioning of the door.

8. The protective barrier system of claim 7, wherein the door base further comprises padding covering the wheel housing on the interior side of the enclosure.

9. The protective barrier system of claim 1, wherein the vertical cable comprises tubing positioned along a length of the vertical cable, the tubing configured to prevent contact between the barrier material and the vertical cable.

10. The protective barrier system of claim 1, wherein the frame has a curvilinear shape.

11. The protective barrier system of claim 10, wherein the frame is U-shaped.

12. The protective barrier system of claim 1, wherein the barrier material is a net, fence, or mesh.

13. The protective barrier system of claim 12, wherein the barrier material comprises ultra-high molecular weight polyethylene.

14. The protective barrier system of claim 1, wherein the base comprises a height adjustment mechanism configured for adjusting the height of the vertical post from the surface.

15. The protective barrier system of claim 1, wherein the protective barrier system further comprises a foundation formed in the surface, wherein the at least one support member is operatively coupled to the foundation.

16. A protective barrier system comprising:

at least one support member positioned on a surface;

a frame comprising an upper portion and a lower portion, the upper portion being coupled to the at least one support member;

a barrier material coupled to and suspended between the upper portion and the lower portion, the barrier material forming an enclosure having an interior and an exterior, wherein the barrier material is spaced from the at least one support member; and a door positioned on the enclosure and configured to provide access to the interior of the enclosure, wherein the door comprises:

a door base;

at least one door support member comprising a vertical post configured for coupling to the door base and at least one curved extension extending from the vertical post; and at least one cable extending from the curved extension to the door base, wherein at least the upper portion of the frame is coupled to the at least one door support member via the cable and the barrier material is spaced from the at least one door support member of the door.

17. The protective barrier system of claim 3, wherein the first curved extension and the second curved extension of the forked support member do not extend parallel to each other.

18. A protective barrier system comprising:

at least one support member configured for coupling to a surface;

a frame comprising an upper portion and a lower portion and a plurality of vertical cables extending therebetween, the upper portion being coupled to the at least one support member;

a barrier material coupled to and suspended between the upper portion and the lower portion of the frame, the barrier material forming an enclosure having an interior and an exterior; and a door positioned relative to the enclosure and configured to provide access to the interior of the enclosure, wherein the barrier material is spaced from the at least one support member, wherein the plurality of vertical cables are positionable adjacent the barrier material on an exterior side of the enclosure, and wherein the frame provides shape and structure to the barrier material.

19. A protective barrier system comprising:

at least one support member configured for coupling to a surface;

a frame comprising an upper portion and a lower portion, the upper portion being coupled to the at least one support member;

a barrier material coupled to and suspended between the upper portion and the lower portion of the frame, the barrier material forming an enclosure having an interior and an exterior; and a door positioned relative to the enclosure and configured to provide access to the interior of the enclosure, wherein each of the upper portion and the lower portion of the frame comprises a lateral support cable operatively coupled to an exterior-facing side of the upper portion and the lower portion, wherein the barrier material is operatively coupled to the frame with one or more attachment mechanisms along the lateral support cable, wherein the barrier material is spaced from the at least one support member, and wherein the frame provides shape and structure to the barrier material.

* * * * *